US005221597A

United States Patent [19]

Fujita et al.

[11] Patent Number: 5,221,597

[45] Date of Patent: Jun. 22, 1993

[54] METHOD FOR PROCESSING SILVER HALIDE COLOR PHOTOGRAPHIC MATERIALS

[75] Inventors: Yoshihiro Fujita; Shinji Ueda; Takatoshi Ishikawa; Akira Abe; Shigeru Nakamura, all of Kanagawa, Japan

[73] Assignee: Fuji Photo Film Co., Ltd., Kanagawa, Japan

[21] Appl. No.: 807,612

[22] Filed: Dec. 13, 1991

Related U.S. Application Data

[63] Continuation of Ser. No. 560,243, Jul. 26, 1990, abandoned, which is a continuation of Ser. No. 309,582, Feb. 13, 1989, abandoned.

[30] Foreign Application Priority Data

| | | | |
|---|---|---|---|
| Feb. 13, 1988 | [JP] | Japan | 63-31120 |
| Feb. 19, 1988 | [JP] | Japan | 63-36549 |
| Jun. 20, 1988 | [JP] | Japan | 63-151796 |

[51] Int. Cl.[5] ..... G03C 7/42

[52] U.S. Cl. ..... 430/393; 430/430; 430/455; 430/460

[58] Field of Search ..... 430/393, 430, 455, 460

[56] References Cited

U.S. PATENT DOCUMENTS

| | | | |
|---|---|---|---|
| 3,879,203 | 4/1975 | Schranz et al. | 430/393 |
| 4,822,726 | 4/1989 | Ikeda et al. | 430/393 |
| 4,840,877 | 6/1989 | Abe et al. | 430/555 |
| 4,876,180 | 10/1989 | Abe et al. | 430/393 |

*Primary Examiner*—Hoa Van Le

*Attorney, Agent, or Firm*—Sughrue, Mion, Zinn, Macpeak & Seas

[57] ABSTRACT

Disclosed is a method of processing a silver halide color photographic material where an imagewise exposed silver halide color photographic material is, after color-developed, processed with a bleaching solution contains (1,3-diamino-propanetetraacetato)iron (III) complex and that, when the material is processed with the said processing solution having a fixing ability, a jet stream of the said processing solution is run against the emulsion surface of the said photographic material. By the method, rapid desilvering is possible, and the material processed is not stained.

18 Claims, 1 Drawing Sheet

METHOD FOR PROCESSING SILVER HALIDE COLOR PHOTOGRAPHIC MATERIALS

This is a continuation of application Ser. No. 07/560,243 filed Jul. 26, 1990, which is a continuation of application Ser. No. 07/309,582, filed Feb. 13, 1989 now both abandoned.

FIELD OF THE INVENTION

The present invention relates to a method for processing an exposed silver halide color photographic material (the term "silver halide color photographic material" is hereinafter abbreviated to "color photographic material") and, in particular, it relates to a method for processing an exposed color photographic material where sufficient desilvering can be effected in a short period of time to give improved photographic properties to the processed material.

BACKGROUND OF THE INVENTION

The basic procedure for processing color photographic material includes, in general, a color-development step and a desilvering step. In the color-development step, the exposed silver halide in a color photographic material is reduced with a color-developing agent to yield silver, while the oxidized color-developing agent is reacted with a coupler to give a color image. In the desilvering step, the silver formed in the previous color-developing step is oxidized by the action of an oxidizing agent (which is generally called a "bleaching agent") and then dissolved by the action of a complexing agent for silver irons (which is generally called a "fixing agent"). After the desilvering step, the thus processed color photographic material may have a color image only.

The desilvering step is conducted either in a two-bath system using a bleaching agent-containing bleaching bath and a fixing agent-containing fixing bath or in a one-bath system using a bleach-fixing bath containing both bleaching agent and fixing agent.

A practical development procedure includes various auxiliary steps, in addition to the above-mentioned basic steps, for the purpose of maintaining the photographic and physical quality of the images formed and of improving the storage stability of the images formed. For instance, such auxiliary steps are conducted using a film-hardening bath, a stopping bath, an image-stabilizing bath and a rinsing bath.

In accordance with the method of the present invention, the term "processing bath having a fixing ability" indicates both the fixing bath and bleach-fixing bath. As the fixing agent for the bath having a fixing ability, thiosulfates which are excellent in fixing capacity and are advantageous in view of their cost are generally used.

On the other hand, in the bleaching step, ferric complexes (for example, aminopolycarboxylic acid iron (III) complexes, especically (ethylenediaminetetraacetato) iron (III) complex) are essentially used in view of the requirements of rapid and simplified processing and of prevention of environmental pollution.

However, ferric complexes are relatively poor in oxidizability and are insufficient in bleaching power. Accordingly, when they are used for bleaching or bleach-fixing a low-sensitivity silver halide color photographic material containing essentially a silver chlorobromide emulsion, the intended object can generally be attained. However, when they are used for processing a high-sensitivity silver halide color photographic material, which essentially contains a silver chlorobromide emulsion or a silver iodobromide emulsion and which has been color-sensitized, especially a picture-taking color reversal photographic material or picture-taking color negative photographic material which contains a silver-rich emulsion, the bleaching capacity is not satisfactory; desilvering is insufficient and a long time is required for bleaching.

As a means of avoiding these deficiences, a method of using a bleaching agent combination of (1, 3-diaminopropanetetraacetato) iron (III) complex and (ethylenediaminetetraacetato) iron (III) complex and having an excellent bleaching power is known, as described in JP-A-62-222252 (the term "JP-A" as used herein means an "unexamined published Japanese patent application").

However, it has been found that when a color photographic material is processed with a processing solution having a fixing ability and containing a thiosulfate, immediately after being processed with a bleaching solution containing the (1, 3-diaminopropanetetraacetato) iron (III) complex, the fixation is retarded and cannot be completed within a determined period of time. Such retardation of fixation is a "fixation insufficiency", which is undesirable.

In a case that aminopolycarboxylic acid which produces a comopound, such as (1,3-diaminopropanetetracetato)iron (III) complex, having a low stability constant in binding to iron (III) is used, the compound causes a remarkable bleaching fog on a photosensitive material and in sufficiency in recoloration of cyan dye, although it has a high bleaching ability.

In addition to such retardation of fixation, another serious problem is that the surface of the photographic material processed is stained.

In order to overcome such problems, *Fuji Film Processing Manual, CN-16 Processing* (October, 1985) has proposed a method where a photographic material is, after processing, fully rinsed or washed with water to remove the components of the bleaching solution from the photographic material processed. Although this method is effective to some degree, this interferes with rapid processing and additionally the number of the necessary processing bath must be increased. Accordingly, such a method is not suitable for use in a mini-laboratory system where rapid processability, small installation space and low processing cost are required.

SUMMARY OF THE INVENTION

Accordingly, a first object of the present invention is to provide a rapid desilvering method for processing color photographic materials.

A second object of the present invention is to provide an excellent and rapid desilvering method for processing color photographic materials where the material processed is not stained.

The third object of the present invention is to provide a rapid desilvering method for processing color photographic materials where the material processed has no bleaching fog and high sufficiency in recoloration.

It has now been found that these and other objects are attained by a method for processing a silver halide color photographic material by the steps of (a) developing an imagewise exposed silver halide color photographic material composed of a support having thereon at least one light-sensitige silver halide emulsion layer; (b)

bleaching the developed color photographic material with a bleaching solution containing (1,3-diaminopropanetetraacetato)iron (III) complex and (c) contacting the emulsion surface of the material from step (b) with a jet stream of a solution having a fixing ability.

DETAILED DESCRIPTION OF THE INVENTION

Figure 1:
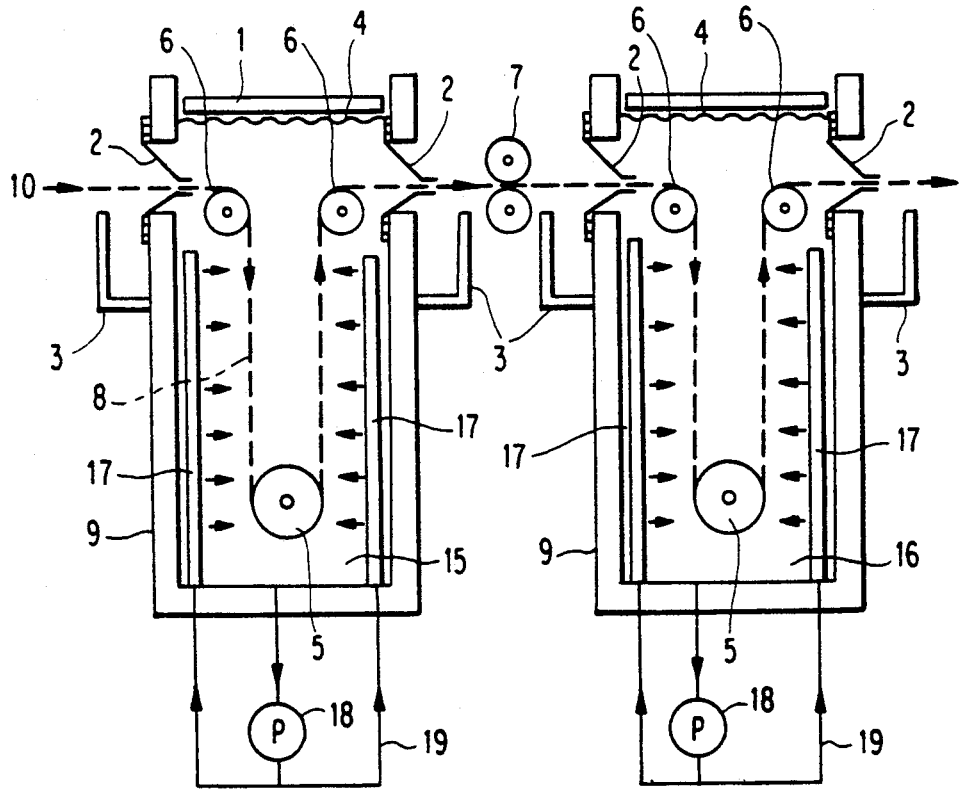
FIG. 1 shows a partial sectional view of one embodiment of an automatic developing apparatus for the method of the present invention.

The cause of the retardation of fixation in processing of a color photographic material with a processing solution having a fixing ability, after the material is bleached with a bleaching solution containing (1,3-diaminopropanetetraacetato) iron (III) complex, as well as the cause of staining of the surface of the photographic material thus processed is not completely known, but without limiting the present invention in any way by theory, is considered to be as follows. Specifically, when a photographic material containing 1,3-diaminopropanetetraacetato) iron (III) complex (hereinafter referred to as "1,3-DPTA.Fe (III)" having a high oxidizing power in the emulsion layer is introduced into the processing solution having a fixing ability and containing a thiosulfate, the 1,3-DPTA.Fe(III) oxidizes the thiosulfate iron in the emulsion layer or near the surface thereof to give a sulfur compound, and the thus-formed sulfur compound strongly adheres to the silver halide in the material to retard the fixation procedure. Further, the sulfur compound, penetrated into the gelatin layer or adhered to the surface near the layer, causes the stains in the material.

In accordance with the method of the present invention, a jet stream of a processing solution having a fixing ability is directed against the photographic material containing 1,3-DPTA.Fe(III), when the photographic material being processed is dipped in the processing solution having a fixing ability, whereby the diffusing of the 1,3-DPTA.Fe(III) from the emulsion layer of the material is noticeably accelerated, to thereby prevent the formation of the sulfur compound in the layer.

Accordingly, the application of the jet stream of the processing solution having a fixing ability to the emulsion layer of the photographic material being processed is preferably conducted as soon as possible after the material has been dipped in the processing solution having a fixing ability.

In accordance with the method of the present invention, the photographic material color-developed is processed in a processing solution having a fixing ability, while a jet stream of the processing solution having a fixing ability is directed against the emulsion surface of the material being processed. The jet steam of the processing solution having a fixing ability may be provided by pumping the solution having a fixing ability onto the emulsion surface of the photographic material being processed from nozzles provided in a position facing the emulsion surface of the material, a distance between the nozzle and the emulsion surface being preferably short, more preferably from 0.2 cm to 1.5 cm. The device providing the jet stream may have from 10 to 200 nozzles, and the device having more nozzles are better. Each nozzle has a size of from 1 mm to 10 mm, and preferably from 1 mm to 5 mm in a diameter and a shape of square, round, hexagon, etc., with no limitation as to the shape of nozzles. More specifically, the method described in JP-A-62-183460, from page 3, right-lower column to page 4, right-lower column (example of the invention) may be employed, in which a solution as transferred under pressure by the action of a pump is jetted out from slits or nozzles provided facing the emulsion surface of the photographic material being processed. The speed of the jet stream ("flow velocity"), when it is directed against the emulsion surface, is preferred to be as high as possible within the range where the jet stream does not interfere with the conveyance of the photographic material, being processed in an automatic developing machine, and specifically, the flow velocity at the nozzle is preferred to fall within the range of from about 0.3 m/sec. to about 3 m/sec, and more preferred from about 2 m/sec. to about 3 m/sec.

In one apparatus useful in the method of the invention, illustrated in FIG. 1, the arrows from the jet stream pipe (13) indicate the jet stream of a fixing solution to be jetted from the nozzles provided in the jet stream pipe. The fixing solution (12) is introduced into the jet stream pipe (13) via the circulation pipe (15) under suction by the pump (14). At the position (4), the emulsion surface of the photographic material being processed faces downwards. In the fixing bath (12), the emulsion surface faces the jet stream pipe.

In accordance with the method of the present invention, it is preferred that the photographic material being processed is introduced into a bath of the solution having a fixing ability and the jet stream of the solution having a fixing ability is directed against the emulsion surface of the material within 15 seconds, more preferably within 10 seconds, after its introduction into the bath.

This time is the time from the contact of a certain point of the photographic material being processed with the processing solution having a fixing ability to the contact of the same point with a vertical jet stream of the processing solution.

The acceleration of the fixation by the application of the jet stream of the processing solution having a fixing ability, in accordance with the method of the present invention, prevents the retardation of fixation because of the 1, 3-DPTA.Fe(III) contained in the emulsion layer of the material being processed, and is basically different from the effect which would be attained in a different system using a bleaching agent of conventional (ethylenediaminetetraacetato) iron (III) complex only. In addition, in accordance with the method of the present invention, another surprising effect of preventing stains in the photographic material processed can be attained.

The present invention is now explained in greater detail.

In the bath having a fixing ability for using in the present invention, a thiosulfate is generally used as the fixing agent. For instance, these include sodium thiosulfate, ammonium thiosulfate and potassium thiosulfate, and use of ammonium thiosulfate is most preferred. The amount of the fixing agent to be added to the bath is preferably from 50 g to 500 g, more preferably from 100 g to 300 g, per liter of the solution having a fixing ability.

In addition, the bath may further contain thiocyanates, thioureas or thioethers, if desired.

The fixing solution for using in the present invention preferably contains an organic phosphonic acid type chelating agent for the purpose of improving the stability of the solution.

Most preferably, 1-hydroxyethylidene-1, 1-diphosphonic acid or N,N,N',N'-ethylenediaminetetraphosphonic acid is used for the purpose.

The amount of the organic phosphonic acid type chelating agent is preferably from 0.005 to 0.5 mol, more preferably from 0.05 to 0.10 mol, per liter of the solution having a fixing ability.

The processing solution having a fixing ability for use in the present invention can contain, as a preservative, sulfites such as sodium sulfite, potassium sulfite or ammonium sulfite, as well as sulfinic acids, hydroxylamine, hydrazines or aldehyde compound-bisulfite adducts such as acetaldehyde-sodium bisulfite. Further, it may also contain various brightening agents, de-foaming agents, and surfactants as well as organic solvents such as polyvinyl pyrrolidone or methanol.

When the bath having a fixing ability for use in the present invention is a bleach-fixing solution, the bath preferably contains the various (aminopolycarboxylato) iron (III) complexes described above as a bleaching agent. The following compounds are most preferred, but the present invention is not to be construed as being limited thereto:

(1, 2-Propylenediaminetetraacetato) iron (III) complex
(1, 3-Propylenediaminetetraacetato) iron (III) complex
(Ethylenediaminetetraacetato) iron (III) complex
(Cyclohexanediaminetetraacetato) iron (III) complex
(Diethylenetriaminepentaacetato) iron (III) complex The amount of the bleaching agent is preferably from 0.1 mol/liter to 0.5 mol/liter. The bleaching agent may be introduced into the bleach-fixing solution as a result of the introduction of the overflow solution from the previous bleaching bath.

The bath having a fixing ability for use in the present invention has a pH of from 4.0 to 9.0, preferably from 5.0 to 8.0. The amount of the replenisher for the bath is from 300 ml to 3000 ml, preferably from 300 ml to 1000 ml, per $m^2$ of the photographic material being processed.

The combined processing time of the photographic material in the bleaching bath and the bath having a fixing ability, in accordance with the method of the present invention, is from 1 minute to 4 minutes, preferably from 1 minute and 30 seconds to 3 minutes. The processing temperature is from 25° C. to 50° C., preferably from 35° C. to 40° C.

Next, the bleaching solution for use in the present invention will be explained in greater detail.

The bleaching solution for use in the present invention contains (1, 3-diaminopropanetetraacetato) iron (III) complex. This complex may be in the form of an alkali metal salt such as a sodium or potassium salt, but the complex is preferably in the form of an ammonium salt, since the bleaching rate of the salt is excellent and it prevents the increase of the yellow density in the non-exposed areas of the photographic material processed. The amount of the 1,3-DPTA.Fe (III) is from 0.05 mol to one mol, preferably from 0.1 mol to 0.5 mol, per liter of the bleaching solution.

In the method of the present invention, any other (aminopolycarboxylato) iron (III) complexes can be incorporated into the bleaching solution together with the 1,3-DPTA.Fe (III), if desired. Especially preferred are ferric complexes of the following compound group (A), although the present invention is not to be construed as being limited thereto:

Compound Group (A)
(A-1) Ethylenediaminetetraacetic acid
(A-2) Diethylenetriaminepentaacetic acid
(A-3) Cyclohexanediaminetetraacetic acid
(A-4) 1,2-Propylenediaminetetraacetic acid When these additional complexes are added to the solution, the molar proportion of the additional complex is 3 mols or less inclusive of 0 mol) per one mol of 1,3-DPTA.Fe (III), in view of the high bleaching power and the small bleaching fog, and more preferably from 0.1 to 3 mols, especially preferably from 0.1 to 1.5 mols, per mol of 1,3-DPTA.Fe (III).

Also in the step of processing the photographic material with the bleaching solution, it is preferred that a jet stream of the bleaching solution is directed against the photographic material being processed within 15 seconds after introduction of the material into the bleaching solution, in the same manner as in the processing step with the processing solution having a fixing ability, to promote acceleration of bleaching, prevention of bleaching fog, prevention of insufficiency in recoloration of cyan dye and acceleration of fixation. In particular, the time is especially preferably within 10 seconds. The effect is especially remarkable when the pH value of the bleaching solution is 5.5 or less.

The bleaching solution for use in the method of the present invention preferably has a pH value of from 5.5 to 2.0, more preferably from 5.0 to 3.0, most preferably from 4.5 to 3.5, for the purpose of attaining sufficient desilvering and of preventing bleached fog. When the pH value of the bleaching solution is 5.5 or less, the bleaching rate is extremely improved and the bleaching fog may noticeably be prevented. However, if the pH value is too low, the ferric complex in the bleaching solution precipitates.

The pH value of conventional bleaching solutions is 5.5 or more, since a lower pH value of the solution would generally cause insufficiency in recoloration of cyan dye. Surprisingly, no insufficiency in recoloration of cyan dye occurrs in the method of the present invention, even when the pH value of the bleaching solution used is lowered, but rapid bleaching can be effected under such low pH condition.

In accordance with the present invention, when the color photographic material is, after color-development, processed with the bleaching solution, it is particularly preferred that the material to be processed is directly introduced into the bleaching solution, without the material being processed with any other intermediate processing solutions (such as a rinsing solution), from the viewpoint of acceleration of the processing.

The crossover time from the color-developer to the bleaching solution, i.e., the time from removing the photographic material being processed from the color-developer to its introduction into the bleaching solution, is desirably 10 seconds or less, preferably 5 seconds or less, especially preferably 3 seconds or less, whereby the bleaching fog or staining of the surface of the photographic material processed may effectively be prevented.

When a photographic material film is processed with an automatic developing machine in accordance with the method of the present invention, various methods may be used to shorten the crossover time. For instance, the transfer speed of the film between the processing tanks can be elevated (in general, the linear velocity is elevated), or the conveyance of the film between the processing solution tanks is effected at a position lower than the liquid level of the first tank or at the position falling within the range of from 0 to several centimeters from the liquid surface of this tank, whereupon a dead space is preferred to be provided between the tanks for the purpose of intermixing of the processing solutions of the respective tanks. Any of these methods can be employed in practice of the present invention.

In the case of a small-sized automatic developing machine (a "mini-laboratory"), the linear velocity in the processing procedure is generally lower than that for a large-sized machine, and the apparatus is required to be small and inexpensive, but it is difficult to shorten the crossover time within 10 seconds, for example 3 seconds or less.

In the case where the crossover time is not extremely shorten, for example, from 5 to 10 seconds or so, the bromide ion concentration in the bleaching solution is preferably from 1.2 mols/liter (or 118 g/liter as $NH_4Br$) to 3.0 mols/liter, more preferably 1.5 to 2.8 mols/liter and most preferably 1.7 to 2.5 mols/liter whereby the yellow density increase is substantially reduced to zero (0).

In addition, the other problem of staining of the film processed may also be prevented by elevation of the bromide ion concentration in the bleaching solution. For instance, the bromide ion concentration is preferably from 1.2 mols/liter (or 118 g/liter as $NH_4Br$) to 3.0 mols/liter, more preferably 1.5 (147 g/liter as $NH_4Br$) to 2.8 mols/liter and most preferably 1.7 to 2.5 mols/liter. When the said concentration is 1.7 mols/liter (or 167 g/liter as $NH_4Br$) or more, staining of the film processed may completely be prevented.

In accordance with the method of the present invention, shortening of the crossover time from the bleaching solution to the processing solution having a fixing ability to 10 seconds or less is preferred, since insufficiency in recoloration of cyan dye can be prevented under such conditions. It is more preferred that the crossover time is shortened as much as possible (i.e., to 5 seconds or less, especially to 3 seconds or less) from the viewpoint of the rapid processing of the method of the invention. Under such conditions of shortened crossover time, the effect of the present invention is remarkable. The above method may be used as the present crossover procedure.

The bleaching solution for use in the method of the present invention may additionally contain various kinds of bleaching accelerators. Preferred bleaching accelerators include various mercapto compounds as described in U.S. Pat. No. 3,893, 858, British Patent 1,138, 842 and JP-A-53-141623; disulfido bond-containing compounds as described in JP-A-53-95630; thiazolidine derivatives as described in JP-B-53-9854 (the term "JP-B" as used herein means an "examined Japanese patent publication"); isothiourea derivatives as described in JP-A-53-94927; thiourea derivatives as described in JP-B-45-8506 and 49-26586; thioamide compounds as described in JP-A-49-42349; and dithiocarbamic acid salts as described in JP-A-55-26506.

In addition, the compounds of formulae (I), (II), (III), (IV), (V), (VI), (VII) and (VIII) disclosed in JP-A-62-222252, pages 4 to 11 are especially preferred for their excellent bleaching capacity. The effect of these compounds is particularly noticeable, when they are used in combination with the jet stream of the bleaching solution applied to the photographic material being processed.

The amount of the comopounds of formulae (I) to (VIII) to be added is preferably from about $1\times10^{-4}$ to about $1\times10^{-1}$ mol/l, more preferably from about $3\times10^{-4}$ to about $1\times10^{-2}$ mol/l and most preferably from about $1\times10^{-3}$ to about $8\times10^{-3}$ mol/l The following compounds are preferred but the present invention is not to be construed as being limited thereto.

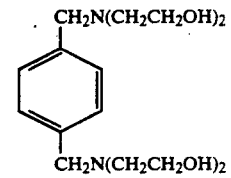

I-1

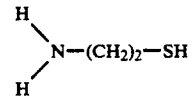

II-1

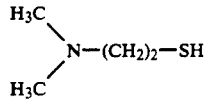

II-2

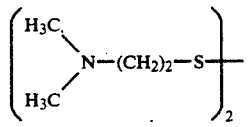

III-1

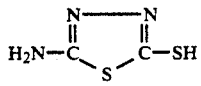

IV-1

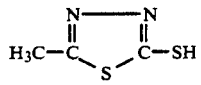

IV-2

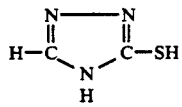

V-1

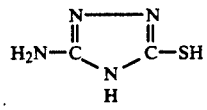

V-2

The bleaching solution for use in the method of the present invention may further contain, in addition to the bleaching agent and the above compounds, any conventional additives which are generally known to be incorporated into conventional bleaching solutions, for example, one or more inorganic acids, organic acids and salts thereof having a pH buffering capacity, such as nitrates (e.g., sodium nitrate, ammonium nitrate), boric acid, sodium metaborate, acetic acid, sodium acetate, sodium carbonate, potassium carbonate, phosphorous acid, phosphoric acid, sodium phosphate, citric acid, sodium citrate or tartaric acid.

In the method of the present invention, the replenishing amount of the fixing solution is from 50 ml to 2000 ml, preferably from 100 ml to 1000 ml, per $m^2$ of the photographic material being processed.

The method of the present invention can be carried out in an automatic developing machine, which will be explained in detail hereunder. In the automatic developing machine to be used for the method of the present invention, stirring of the processing solution having a fixing ability is preferably increased as much as possible, whereby the time required for desilvering may be shortened. Specific ways of increasing stirring in the step include a method of applying a jet stream of a processing solution to the emulsion surface of the photographic material being processed, as described in JP-A-62-183460 mentioned before; a method of using a rotating means to elevate the stirring effect in a processing solution, as described in JP-A-62-183461; a method of moving the photographic material being processed while the emulsion surface of the material is contacted with a wiper blade provided in the inside of the processing bath so that the processing solution near the the emulsion surface is made turbulent to thereby elevate the stirring of the bath; and a method of increasing the circulating flow of the total processing solution. Such means are preferably used for increasing the stirring of the fixing solution and bleach-fixing solution as well as bleaching solution. The increase of the stirring of the processing solution is considered to accelerate the introduction of the bleaching agent and the fixing agent into the emulsion layer of the photographic material being processed, and as a result, to elevate the desilvering rate in the processing step.

The stirring acclerating means is more effective when a bleaching accelerator is used, whereby the bleaching accelerating effect can noticeably be enhanced and the fixation retardation or insufficiency may be eliminated because of the bleaching accelerator.

The automatic developing machine to be used for the method of the present invention is preferred to have a means of conveying the photographic material being processed, as described in JP-A-60-191257, 60-191248 and 60-191259. As described in the JP-A-60-191257, the conveyance means is effective for noticeably reducing the carryover of the processing solution from the prior bath to the later bath and therefore is also effective for preventing deterioration of the processing solution used. This is especially meaningful for shortening the processing time in the respective processing steps and for reducing the amount of the replenisher for the respective processing steps.

The color developer for use in the method of the present invention contains known aromatic primary amine color developing agents. Preferred examples of the color developing agents for use in the present invention are p-phenylenediamine derivatives. Specific examples of such derivatives are mentioned below, which, however, are not to be construed as limiting the scope of the present invention.

D-1: N,N-diethyl-p-phenylenediamine
D-2: 2-Amino-5-diethylaminotoluene
D-3: 2-Amino-t-(N-ethyl-N-laurylamino)toluene
D-4: 4-[N-ethyl-N-(β-hydroxyethyl)amino]aniline
D-5: 2-Methyl-4-[N-ethyl-N-(β-hydroxyethyl-)amino]aniline
D-6: 4-Amino-3-methyl-N-ethyl-N-[β-(methanesulfonamido)-ethyl]aniline
D-7: N-(2-amino-5-diethylaminophenylethyl) methanesulfonamide
D-8: N,N-dimethyl-p-phenylenediamine
D-9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-n-ethyl-n-β-butoxyethylaniline Among these p-phenylenediamine derivatives, (D-5) is especially preferred.

The p-phenylenediamine derivatives may also be in the form of salts such as sulfates, hydrochlorides, sulfites or p-toluenesulfonates. The amount of the aromatic primary amine developing agent contained in the color developer is preferably from about 0.1 g to about 20 g, more preferably from about 0.5 g to about 10 g or so, per liter of the developer.

The color developer for use in the present invention can further contain, if desired, sulfites, such as sodium sulfite, potassium sulfite, sodium bisulfite, potassium bisulfite, sodium metasulfite or potassium metasulfite, as well as carbonyl-sulfite adducts, as a preservative.

The preferred amount of the preservative to be added to the color developer is from 0.5 g to 10 g, more preferably from 1 g to 5 g, per liter of the developer.

As compounds capable of directly preserving the color developing agents, various hydroxylamines, the hydroxamic acids described in JP-A-63-43138, the hydrazines and hydrazides described in JP-A-63-146041, the phenols described in JP-A-63-44657 and 63-58443, the α-hydoroxyketones and α-aminoketones described in JP-A-63-44656 and/or various saccharides described in JP-A-63-36244 are preferably added to the color developer. Further, in combination with these compounds, the monoamines described in JP-A-63-4235, 63-24254, 63-21647, 63-146040, 63-27841 and 63-25654, the diamines described in JP-A-63-30845, 63-146040 and 63-43139, the polyamines described in JP-A-63-21647 and 63-26655, the polyamines described in JP-A-63-44655, the nitroxy radicals described in JP-A-63-44655, the nitroxy radicals described in JP-A-63-53551, the alcohols described in JP-A-63-43140 and 63-53549, the oximes described in JP-A-63-56654, and the tertiary amines described in EP-248450A may preferably be used.

As other preservatives, various metals described in JP-A-57-44148 and 57-53749, the salicylic acids described in JP-A-59-180588, the alkanolamines described in JP-A-54-3532, the polyethyleneimines described in JP-A-56-94349, and the aromatic polyhydroxy compounds described in U.S. Pat. No. 3, 746, 544 may optionally be incorporated into the color developer for use in the present invention. In particular, incorporation of aromatic polyhydroxy compounds as a preservative is preferred.

The color developer for use in the present invention preferably has a pH value of from 9 to 12, more preferably from 9 to 11.0, and the color developer can contain various known developer components in addition to the above-mentioned ingredients.

In order to maintain this pH value, the color developer preferably contains various buffers.

Specific examples of useful buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (potassium 5-sulfosalicylate). However, these compounds are not intended to restrict the scope of the present invention.

The amount of the buffer to be added to the color developer is preferably 0.1 mol/liter or more, and is especially preferably from 0.1 mol/liter to 0.4 mol/liter.

In addition, the color developer may also contain various chelating agents as an agent for preventing precipitation of calcium or magnesium or for the purpose of improving the stability of the color developer.

As the chelating agents organic acid compounds are preferred, in particular e.g., aminopolycarboxylic acids, organic phosphonic acids and phosphonocarboxylic acids. Specific examples of the acid compounds include nitrilotriacetic acid, diethylene-triaminepentaacetic acid, ethylenediaminetetraacetic acid, N,N,N-trimethylenephosphonic acid, ethylenediamine-N,N,N' ,N'-tetramethylenephosphonic acid, transcyclohexanediaminetetraacetic acid, 1,2-diaminopropanetetraacetic acid, hydroxyethylimino-diacetic acid, glycol ether diaminetetraacetic acid, ethylenediamino-orthohydroxyphenylacetic acid, 2-phosphonobutane-1,2,4-tricarboxylic acid, 1-hydroxyethylidene-1, 1-diphosphonic acid and N,N-bis(2-hydroxybenzyl)ethylenedimaine-N,N'-diacetic acid. These examples are not limitative. These chelating agents may be used alone or in the form of a mixture of two or more of them, if desired.

The amount of the chelating agent to be added to the color developer is any that is sufficient for sequestering the metal ion in the color developer. For instance, the amount may be from 0.1 g to 10 g or so per liter of the developer.

The color developer may contain any optional development accelerator, if desired. However, it is preferred that the color developer for use in the present invention is substantially free from benzyl alcohol, in view of the prevention of environmental pollution, the easiness of the preparation of the developer solution and the prevention of fog. The term "substantially free from benzyl alcohol" means that the content of benzyl alcohol in the developer is 2 ml or less per liter of the developer, and preferably the developer contains no benzyl alcohol.

Other development accelerators which can be added to the color developer for use in the present invention, include, for example, the thioether compounds described in JP-B-37-16088, 37-5978, 38-7826, 44-12380 and 45-9019 and U.S. Pat. No. 3,813,247, the p-phenylenediamine compounds described in JP-A-52-49829 and 50-15554, the quaternary ammonium salts described in JP-A-50-137726, JP-B-44-30074 and JP-A-56-156826 and 52-43429, the amine compounds described in U.S. Pat. Nos. 2,494,903, 3,128,182, 4,230,796 and 3,253,919, JP-B-41-11431, U.S. Pat. Nos. 2,482,546, 2,596,926 and 3,582,346, the polyalkyleneoxides described in JP-B-37-16088 and 42-25201, U.S. Pat. No. 3,18,183, JP-B-41-11431 and 42-23883 and U.S. Pat. No. 3,532,501 and well as other 1-phenyl-3-pyrazolidones and imidazoles.

In accordance with the present invention, any optional anti-foggant can be added to the color developer, if desired. As the anti-foggant can be used alkali metal halides such as sodium chloride, potasium bromide or potassium idodide, as well as organic anti-foggants. As specific examples of organic anti-foggants which may be used in the present invention, there are nitrogen-containing heterocyclic compounds such as benzotriazole, 6-nitrobenzimidazole, 5-nitroisoindazole, 5-methylbenzotriazole, 5-nitrobenzotriazole, 5-chloro-benzotriazole, 2-thiazolyl-benzimidazole, 2-thiozolylmethylbenzimidazole, indazole, hydroxyazaindolidine and adenine.

The color developer for use in the present invention preferably contains a brightening agent. As the brightening agent are preferred 4,4'-diamino-2, 2'-disulfostylbene compounds. The amount of the brightening agent to be added to the color developer is up to 5 g/liter, preferably from 0.1 to 4 g/liter.

In addition, various kinds of surfactants can be added to the color developer, if desired, including alkylsulfonic acids, arylsulfonic acids, aliphatic carboxylic acids, and aromatic carboxylic acids.

The processing temperature of the color developer of the present invention is from 20° to 50° C., preferably from 30° to 45° C. The processing time is from 20 seconds to 5 minutes, preferably from 30 seconds to 3 minutes. The amount of the replenisher is preferably small and is, for example, from 100 to 1500 ml, preferably from 100 to 800 ml, more preferably from 100 to 400 ml, per $m^2$ of the photographic material processed.

The color development may be effected in a multi-bath system containing two or more baths, where a replenisher for color developer is introduced into the first bath or into the last bath so that the development time may be shortened and the amount of the replenisher may be reduced.

The processing method of the present invention can be applied to color reversal processing. In such color reversal processing, a first black-and-white developer which is generally used in conventional reversal processing of general color photographic materials or a common black-and-white developer which is generally used for processing of conventional black-and-white developer can be incorporated into the developer.

Examples of typical additives, include a developing agent such as 1-phenyl-3-pyrazolidone, Metol or hydroquinone, a preservative such as sulfites, an alkali accelerator such as sodium hydroxide, sodium carbonate or potassium carbonate, an inorganic or organic inhibitor such as potassium bromide, 2-methylbenzimidazole or methylbenzothiazole, a water softener such as polyphosphates, and a development accelerator such as a trace amount of iodides or mercapto compounds.

The processing method of the present invention includes the processing steps of color development, bleaching, bleach-fixation and fixation. After the bleach-fixation or fixation step, the photographic material processed is generally subjected to a processing step of rinsing in water or stabilization. After being processed in the bath having a fixing ability, the material may simply and directly be subjected to stabilization, without substantial rinsing in water.

Known additives may be added to the rinsing water used in the rinsing step, if desired. For instance, a water softener such as inorganic phosphoric acids, aminopolycarboxylic acids or organic phosphoric acids; a bactericide or fungicide for preventing propagation of various bacteria, fungi and algae (such as isothiazolines, organic chlorine-containing bactericides, benzotriazoles); as well as a surfactant for preventing drying load or unevenness may be added to the rinsing water. In addition, the compounds described in L. E. West, "Water Quality Criteria" *Phot. Sci. and Eng.*, Vol. 9, No. 6, pages 34 to 359, (1965) may also be used for the purpose.

As the stabilizing solution used in the stabilization step, a processing solution for stabilizing the color images formed is used. For instance, a solution having a buffering capacity for a pH value of from 3 to 6, as well as a solution containing an aldehyde (such as formalin) can be used. The stabilizing solution may contain, if desired, an ammonium compound, a metal compound such as Bi or Al compound, a brightening agent, a chelating agent (such as 1-hydroxy-ethylidene-1, 1-diphosphonic acid), a bactericide, a fungicide, a film hardening agent and a surfactant.

For the rinsing step or stabilization step, a multistage countercurrent system is preferred. The number of the stages is preferably from 2 to 4 stages. The amount of the replenisher to the step is from 1 to 50 times, preferably from 2 to 30 times, more preferably from 2 to 15 times, the carryover amount from the previous bath, per unit area of the photographic material being processed.

As the water used in the rinsing step or stabilization step, city water, water deionized by treatment with an an ion-exchange resin to have a Ca or Mg concentration of 5 mg/liter or less, and water as sterilizing by treatment with a halogen or ultraviolet sterilizing lamp is preferred.

When the method of the present invention is carried out continuously by the use of an automatic developing machine, the processing solution is often concnetrated by evaporation during processing. In particular, when the amount of the photographic material to be processed is small or when the open area of the processing solution is large, such concentration of the processing solution is noticeable. In order to compensate the thus-concentrated processing solution, a proper amount of water or replenisher is preferably added to the processing solution.

The overflow from the rinsing bath or stabilization bath may preferably be re-circulated to the previous bath having a fixing ability, whereby the amount of the drainage from the method may advantageously be reduced.

The silver halide incorporated into the photographic emulsion layer of the photographic material to be processed by the method of the present invention is silver chloride, silver bromide, silver chlorobromide, silver iodochloride, silver chloroiodobromide or silver iodobromide. It is preferred that the silver halide is that containing silver iodide in an amount of 30 mol % or less, preferably about 1 mol % to about 25 mol %. More preferably, the silver halide is silver iodobromide, silver iodochloride or silver iodochlorobromide containing about 30 mol % or less silver iodide. Especially preferably, it is silver iodobromide containing silver iodide in an amount of from about 1 mol to about 25 mol %.

The silver halide grains in the photographic emulsion may have a regular crystal form such as a cubic, octahedral or tetradecahedral crystal form, or an irregular crystal form such as a spherical or tabular crystal form, or a crystal form having a crystal defect such as a twin plane, or further a composite form of these crystal forms.

Regarding the grain size of the silver halide grains, the grains may be fine grains having a grain size of about 0.2 μm or less or may be large-sized grains having a projected area diameter of up to about 10 μm. The emulsion of the grains may be either a polydispersed emulsion or a monodispersed emulsion.

As one embodiment of the silver halide emulsion for use in the present invention, an emulsion with a distribution where the maximum grain size of the grains in the grain group of up to 30% by number as counted from the smallest grains in the emulsion is 0.3 μm or less, especially preferably 0.17 μm or less, as the sphere-corresponding diameter may be used, which is illustrated in European Patent 285,176. Such emulsion is excellent in high sharpness, small color turbidity and broad exposure latitude.

The silver halide photographic emulsions to be used in the present invention can be prepared, for example, by the methods described in *Research Disclosure* (RD), Item 17643 (December 1978), pages 22 to 23, "I. Emulsion Preparation and Types"; RD Item 18716 (November 1979), page 648; P. Glafkides, *Chemie et Phisique Photographique* (Paul Montel, 1967); and G. F. Duffin, *Photographic Emulsion Chemistry* (Focal Press, 1966); and V. L. Zelikman et al., *Making and Coating Photographic Emulsion* (Focal Press, 1964).

In addition, the monodispersed emulsions described in U.S. Pat. Nos. 3,574,628 and 3,655,394 and British Patent 1,413,748 are also preferably used.

Further tabular grains having an aspect ratio of about 5 or more may also be used. Such tabular grains may easily be prepared by the methods described, for example, in Gutoff, Photographic Science and Engineering, Vol. 14, pages 278 to 257 (1970), U.S. Pat. Nos. 4,434,226, 4,414,310, 4,433,043 and 4,439,520 and british Patent 2,112,157.

The crystal structure of the silver halide grains may be uniform throughout the whole grain, or the inside part and the outside part of one grain may have different halogen compositions, or one grain may have a layered structure. Further, silver halides of different compositions may be jointed by epitaxial junction or a silver halide may also be jointed with other compounds than silver halides, such as silver rhodanide or lead oxide, to form silver halide grains with a junction struchture.

A mixture of grains of various crystal forms may also be used in the present invention.

The silver halide emulsion for use in the present invention is, in general, physically ripened, chemically ripened and spectrally sensitized. Additives for the ripening step or sensitizing step are described in *Research Disclosure,* Items 17643 and 18716, and the relevant parts are summarized in the following Table.

Known photographic additives which can be used in the present invention are also described in these two *Research Disclosures,* and the relevant parts are also summarized in the same Table.

| Kinds of Additives | RD 17643 | RD 18716 |
|---|---|---|
| 1. Chemical Sensitizer | p. 23 | p. 648, right column |
| 2. Sensitivity-enhancer | | p. 648, right column |
| 3. Spectral Sensitizer<br>Super Color Sensitizer | pp. 23–24 | from p. 648, right column to<br>p. 649, right column |
| 4. Brightening Agent | p. 24 | |
| 5. Anti-foggant<br>Stabilizer | pp. 24–25 | p. 649, right column |
| 6. Light Absorbent | pp. 25–26 | from p. 649, right column to |

-continued

| Kinds of Additives | RD 17643 | RD 18716 |
|---|---|---|
| Filter Dye | | p. 650, left column |
| UV Absorbent | | |
| 7. Stain Inhibitor | p. 25, right column | p. 650, from left to right column |
| 8. Color Image Stabilizer | p. 25 | |
| 9. Hardening Agent | p. 26 | p. 651, left column |
| 10. Binder | p. 26 | p. 651, left column |
| 11. Plasticizer | p. 27 | p. 650, right column |
| Lubricant | | |
| 12. Coating Aid | pp. 26–27 | p. 650, right column |
| Surfactant | | |
| 13. Antistatic Agent | p. 27 | p. 650, right column |

Various color couplers may be incorporated into the color photographic materials to be processed by the method of the present invention. Specific examples of couplers usable in the materials are described in the patent publications referred to in *Research Disclosure* (RD) item 17643, VII-C to G.

As yellow couplers, for example, the compounds described in U.S. Pat. Nos. 3,933,501, 4,022,620, 4,326,024 and 4,401, 752, JP-B-58-10739, British Patents 1,425,020 and 1,476,760 are preferred.

As magenta coulpers, 5-pyrazolone and pyrazoloazole compounds are preferred. For example, the compounds described in U.S. Pat. Nos. 4,310,619 and 4,351,894, European Patent 73,636, U.S. Pat. Nos. 3,061,432, and 3,725,067, *Research Disclosure Item* 24,220 (June, 1984), JP-A-60-33552, *Research Disclosure Item* 24,230 (June, 1984), JP-A-60-43659 and U.S. Pat. Nos. 4,500,630 and 4,540,654 are especially preferred.

As cyan couplers, phenol coulpers and naphthol couplers can be used. For example, the compounds described in U.S. Pat. Nos. 4,052,212, 4,146,396, 4,228,233, 4,296,200, 2,369,9292, 2,801,171, 2,772,162, 2,895,826, 3,772,002, 3,758,308, 4,334,011 and 4,327,137, West German Patent Application (OLS) No. 3,329,729, European Patent 121,365A, U.S. Pat. Nos. 3,446,622, 4,333,999, 4,451,559 and 4,427,767 and European Patent 161, 626A are preferred.

Especially preferred cyan couplers are 5-amidonaphthol type cyan couplers described in European Patent 161,626A, JP-A-60-237448, 61-143640 and 61-145557, JP-A-62-123157, 62-123158, 62-269958 and 63-258446 and Japanese Patent Application No. 63-36542.

Specific examples of such couplers include the following compounds but the present invention is not to be construed as being limited thereto.

C-1

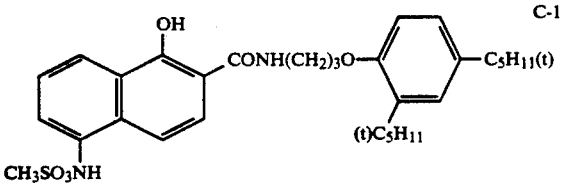

C-2

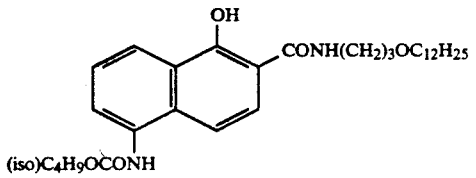

-continued

C-3

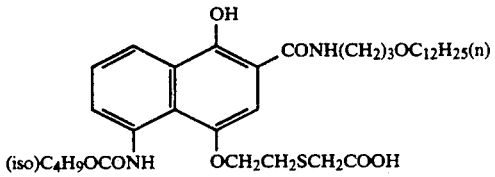

C-4

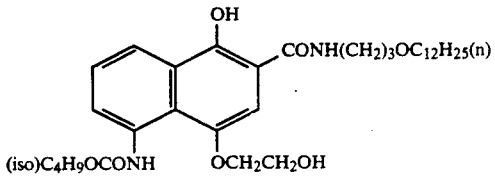

C-5

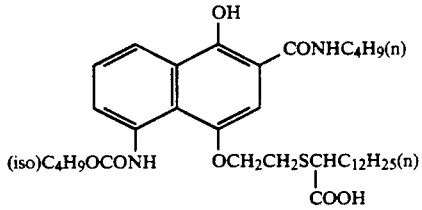

C-6

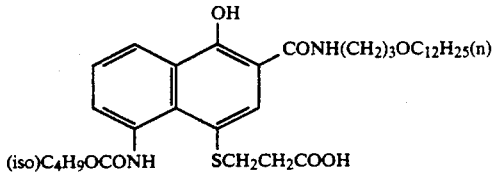

C-7

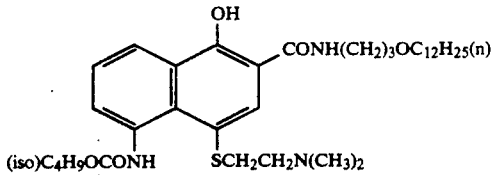

As colored couplers for correcting the unnecessary absorption of the colored dyes, the compounds described in *Research Disclosure* Item 17643, VII-G, U.S. Pat. No. 4,163,670, JP-B-57-39413, U.S. Pat. Nos. 4,004,929 and 4,138,258 and British Patent 1,146,368 are preferred.

As couplers capable of forming colored dyes having a suitable diffusibility, the compounds described in U.S. Pat. No. 4,366,237, British Patent 2,125,570, European Patent 96,570 and West German Patent Application (OLS) No. 3,234,533 are preferred.

Specific examples of polymerized dye-forming couplers which may be used in the present invention are described in U.S. Pat. Nos. 3,451,820, 4,080,211 and 4,367,282 and British Patent 2,102,173.

Couplers capable of releasing a photographically useful group by coupling may also be preferably used in the present invention. As DIR couplers capable of releasing a development inhibitor, the compounds described in the patent publications referred to in the RD Item 17,643, VII-F as well as those described in JP-A-57-151944, 57-154234 and 60-184248 and U.S. Pat. No. 4,248,962 are preferred.

As couplers capable of imagewise releasing a nucleating agent or a development accelerator in development, the compounds described in British Patents 2,097,140 and 2,131,188 and JP-A-59-157638 and 59-170840 are preferred.

In addition, couplers which can be used in the photographic material for the present invention, include the competing couplers described in U.S. Pat. No. 4,130,427, the polyequivalent couplers described in U.S. Pat. No. 4,130,427, the polyequivalent couplers described in U.S. Pat. No. 4,283,472, 4,338,393 and 4,310,618, the DIR redox compound-releasing couplers described in JP-A-60-185950, and the couplers capable of releasing a dye, which may be recolored after release, described in European Patent 173,302A.

The couplers for use in the present invention can be incorporated into the photographic materials by various known dispersing methods.

For instance, a water-in-oil dispersing method may be employed, and examples of high boiling point solvent to be used in the same method are described in U.S. Pat. No. 2,322,027.

A method of using a polymer as a coupler-dispersing medium may be also be employed, which is described in JP-B-48-30494, U.S. Pat. No. 3,619,195, West German Patent 1,957,467 and JP-B-51-59835.

A latex-dispersing method may further be employed, and the steps of the method, the effect of the method and examples of dipping latexes to be used in the method are described in U.S. Pat. No. 4,199,363, West German Patent Application (OLS) Nos. 2,541,274 and 2,541,230.

The photographic materials to be processed by the method of the present invention may contain a compound which may release a compound by reaction with the oxidation product of a developing agent, whereupon the thus-released compound further reacts with the oxidation product of another molecule of the developing agent to thereby release a development inhibitor. Examples of the compound of the type are described in European Patent 285,176.

Specifically, such compounds include the following compounds, but the present invention is not to be construed as being limited thereto:

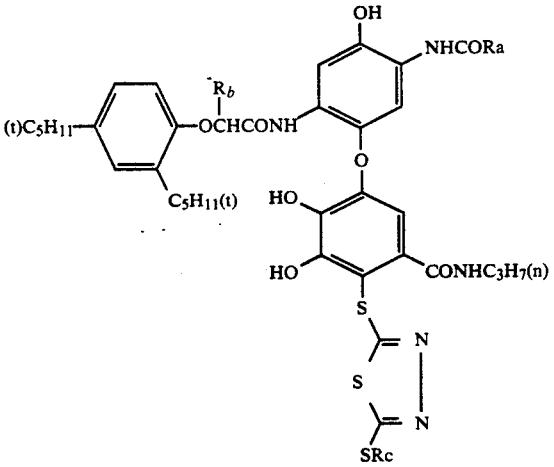

$R_a = C_3F_7(n)$ $R_b = H$ $R_c = -CH_2CH_2CO_2CH_3$ D-1

$R_a = C_3F_7(n)$ $R_b = -C_2H_5$ $R_c = -CH_2CH_2CO_2CH_3$ D-2

$R_a = C_3F_7(n)$ $R_b = H$ $R_c = -CH(CH_3)CO_2CH_3$ D-3

$R_a = C_3F_7(n)$ $R_b = -C_2H_5$ $R_c = -CH(CH_3)CO_2CH_3$ D-4

$R_a = C_3F_7(n)$ $R_b = H$ $R_c = -CH_2CO_2CH_3$ D-5

$R_a = C_3F_7(n)$ $R_b = -C_4H_9(n)$ $R_c = -CH_2CO_2CH_3$ D-6

$R_a = (t)C_4F_9$ $R_b = H$ $R_c = -CH_2CH_2CO_2CH_3$ D-7

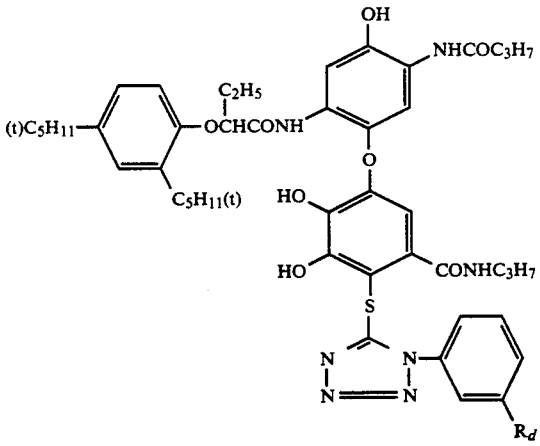

$R_d = H$ D-8

$R_d = COOC_2H_5$ D-9

Incorporation of 5-amidohydroquinone derivatives (described in European Patent 284,082) into the photographic materials for the present invention is preferred, as these derivatives are excellent in high color reproducibility, small sensitivity fluctuation in running procedure, small insufficiency in recoloration and fine graininess.

Specific examples of such derivatives include the following compounds, but the present invention is not to be construed as being limited thereto:

E-1

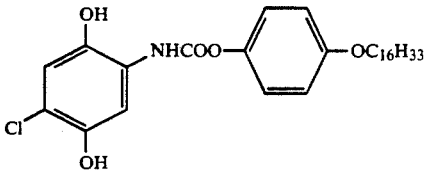

E-2

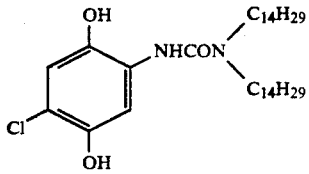

E-3

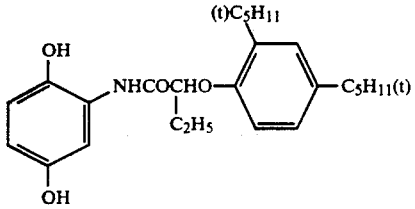

E-4

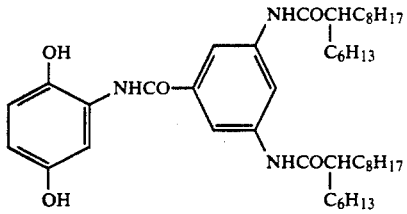

E-5

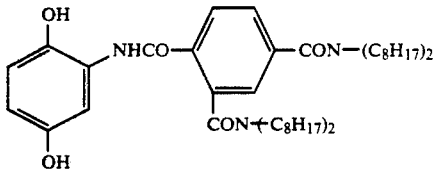

Supports which may suitably be used for the photographic materials to be processed by the method of the present invention may be those described, for example, in the RD Item 17643, page 28 and Item 18716, from page 647, right-hand column to page 648, left-hand column.

The following examples are provided to illustrate specific emboidments of the present invention in greater detail, but are not to be construed as limiting the scope of the present invention. Unless otherwise indicated all parts, ratios and percentages are by weight.

EXAMPLE 1

A multilayer color photographic material (Sample A) was prepared by forming the layers having the compositions shown below on a subbed cellulose triacetate film support.

The compositions of the layers were as follows. The amount coated was represented by the unit of g/m$^2$ as silver, for silver halide and colloidal silver. It was represented by the unit of g/m$^2$ for couplers, additives and gelatin. It was represented by the number of mols per mol of the silver halide in the same layer, for sensitizing dyes.

| | |
|---|---|
| **First Layer: Anti-halation Layer** | |
| Black Colloidal Silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |
| **Second Layer: Interlayer** | |
| Gelatin | 1.0 |
| UV-1 | 0.03 |
| ExC-4 | 0.02 |
| ExF-1 | 0.004 |
| Solv-1 | 0.1 |
| Solv-2 | 0.1 |
| **Third Layer: Low-sensitive Red-sensitive Emulsion Layer** | |
| Silver Iodobromide Emulsion (AgI 4 mol %; uniform AgI type; sphere-corresponding diameter 0.5 μm; variation coefficient of sphere-corresponding diameter 20%; tabular grains; ratio of diameter/thickness 3.0) | 1.2 as Ag |
| Silver Iodobromide Emulsion (AgI 3 mol %; uniform AgI type; sphere-corresponding diameter 0.3 μm; variation coefficient of sphere-corresponding diameter 15%; spherical grains; ratio of diameter/thickness 1.0) | 0.6 as Ag |
| Gelatin | 1.0 |
| ExS-1 | $4 \times 10^{-4}$ |
| ExS-2 | $4 \times 10^{-5}$ |
| ExC-1 | 0.05 |
| ExC-2 | 0.50 |
| ExC-3 | 0.03 |
| ExC-4 | 0.12 |
| ExC-5 | 0.01 |
| **Fourth Layer: High-sensitive Red-sensitive Emulsion Layer** | |
| Silver Iodobromide Emulsion (AgI 6 mol %; uniform AgI-rich core type grains with core/shell ratio of 1/1; sphere-corresponding diameter 0.7 μm; variation coefficient of sphere-corresponding diameter 15%; tabular grains; ratio of diameter/thickness 5.0) | 0.7 as Ag |
| Gelatin | 1.0 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |
| **Fifth Layer: Interlayer** | |
| Gelatin | 0.5 |
| Cpd-1 | 0.1 |
| Solv-1 | 0.05 |
| **Sixth layer: Low-sensitive Green-sensitive Emulsion Layer** | |
| Silver Iodobromide Emulsion (AgI 4 mol %; AgI-rich shell type grains with core/shell ratio of 1/1; sphere-corresponding diameter 0.5 μm; variation coefficient of sphere-corresponding diameter 15%; tabular grains; ratio of diameter/thickness 4.0) | 0.35 as Ag |
| Silver Iodobromide Emulsion (AgI 3 mol %; uniform AgI type; sphere-corresponding diameter 0.3 μm; variation coefficient of sphere-corresponding diameter 25%; spherical grains; ratio of diameter/thickness 1.0) | 0.20 as Ag |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-14 | 0.03 |
| Solv-1 | 0.3 |
| Solv-4 | 0.05 |
| **Seventh Layer: High-sensitive Green-sensitive Emulsion Layer** | |
| Silver Iodobromide Emulsion (AgI 4 mol %; AgI-rich core type grains with | 0.8 as Ag |

-continued

| | |
|---|---|
| core/shell ratio of 1/3; sphere-corresponding diameter 0.7 μm; variation coefficient of sphere-corresponding diameter 20%; tabular grains; ratio of diameter/thickness 5.0) | |
| Gelatin | 0.5 |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.01 |
| Solv-1 | 0.2 |
| Solv-4 | 0.01 |
| **Eighth Layer: Interlayer** | |
| Gelatin | 0.5 |
| Cpd-1 | 0.05 |
| Solv-1 | 0.02 |
| **Nineth Layer: Donor Layer for Interlayer Effect to Red-sensitive Layer** | |
| Silver Iodobromide Emulsion (AgI 2 mol %; AgI-rich core type grains with core/shell ratio of 2/1; sphere-corresponding diameter 1.0 μm; variation coefficient of sphere-corresponding diameter 15%; tabular grains; ratio of diameter/thickness 6.0) | 0.35 as Ag |
| Silver Iodobromide Emulsion (AgI 2 mol %; AgI-rich core type grains with core/shell ratio of 1/1; sphere-corresponding diameter 0.4 μm; variation coefficient of sphere-corresponding diameter 20%; tabular grains; ratio of diameter/thickness 6.0) | 0.20 as Ag |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.2 |
| **Tenth Layer: Yellow Filter Layer** | |
| Yellow Colloidal Silver | 0.05 |
| Gelatin | 0.5 |
| Cpd-2 | 0.13 |
| Solv-1 | 0.13 |
| Cpd-1 | 0.10 |
| **Eleventh Layer: Low-sensitive Green-sensitive Emulsion Layer** | |
| Silver Iodobromide Emulsion (AgI 4.5 mol %; uniform AgI type; sphere-corresponding diameter 0.7 μm; variation coefficient of sphere-corresponding diameter 15%; tabular grains; ratio of diameter/thickness 7.0) | 0.3 as Ag |
| Silver Iodobromide Emulsion (AgI 3 mol %; uniform AgI type; sphere-corresponding diameter 0.3 μm; variation coefficient of sphere-corresponding diameter 25%; tabular grains; ratio of diameter/thickness 7.0) | 0.15 as Ag |
| Gelatin | 0.5 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 1.0 |
| Solv-1 | 0.20 |
| **Twelfth Layer: High-sensitive Blue-sensitive Emulsion Layer** | |
| Silver Iodobromide Emulsion (AgI 10 mol %; AgI-rich core type grains; sphere-corresponding diameter 1.0 μm; variation coefficient of sphere-corresponding diameter 25%; multi-layered twin tabular grains; ratio of diameter/thickness 2.0) | 0.5 as Ag |
| Gelatin | 0.5 |
| ExS-6 | $1 \times 10^{-4}$ |
| ExY-15 | 0.20 |
| ExY-13 | 0.01 |
| Solv-1 | 0.10 |
| **Thirteenth Layer: First Protective Layer** | |
| Gelatin | 0.8 |
| UV-4 | 0.1 |
| UV-5 | 0.15 |
| Solv-1 | 0.01 |
| Solv-2 | 0.01 |
| **Fourteenth Layer: Second Protective Layer** | |
| Fine Silver Bromide Grain Emulsion (AgI 2 mol %; uniform AgI type; sphere-corresponding diameter 0.07 μm) | 0.5 |
| Gelatin | 0.45 |
| Polymethyl Methacrylate Grains (diameter 1.5 μm) | 0.2 |
| H-1 | 0.4 |
| Cpd-5 | 0.5 |
| Cpd-6 | 0.5 |

In addition to the above-mentioned components, the respective layers contained a stabilizer Cpd-3 (0.04 g/m²) and a surfactant Cpd-4 (0.02 g/m²) as coating aids.

The compounds used were as follows:

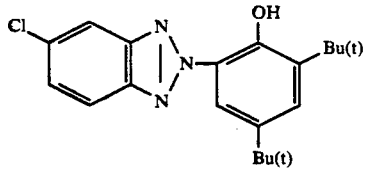

UV-1

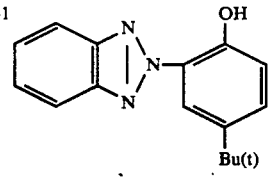

UV-2

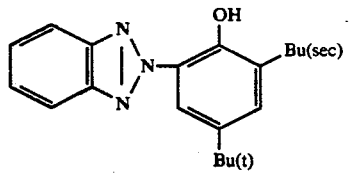

UV-3

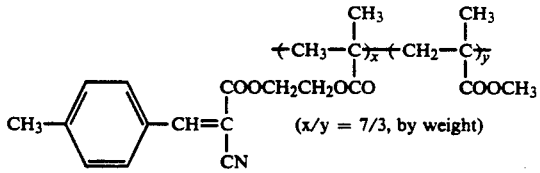

UV-4

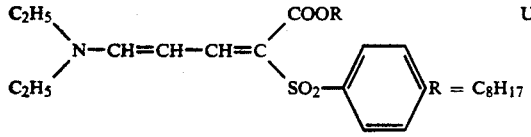

UV-5

Tricresyl Phosphate

Solv-1

-continued
Dibutyl Phthalate
Solv-2
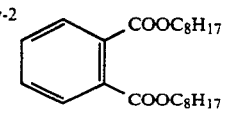
Solv-3
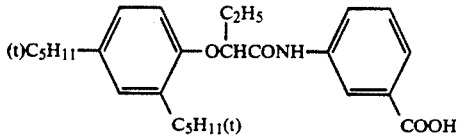
Solv-4
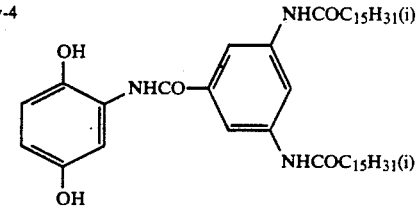
Cpd-1
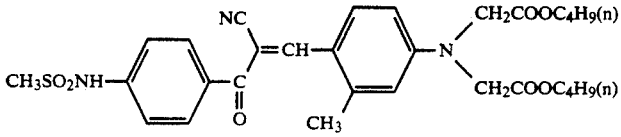
Cpd-2
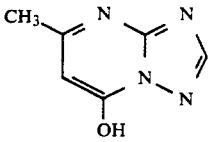
Cpd-3
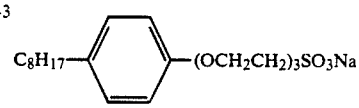
Cpd-4
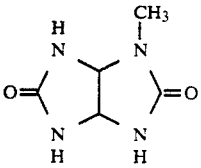
Cpd-5
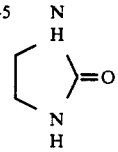
Cpd-6
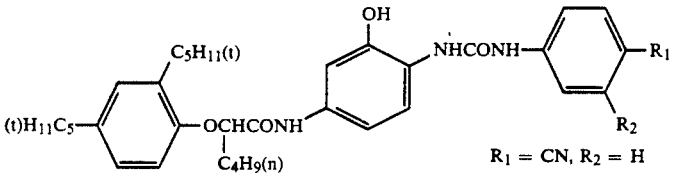
ExC-1
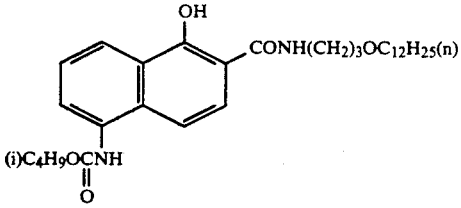
ExC-2
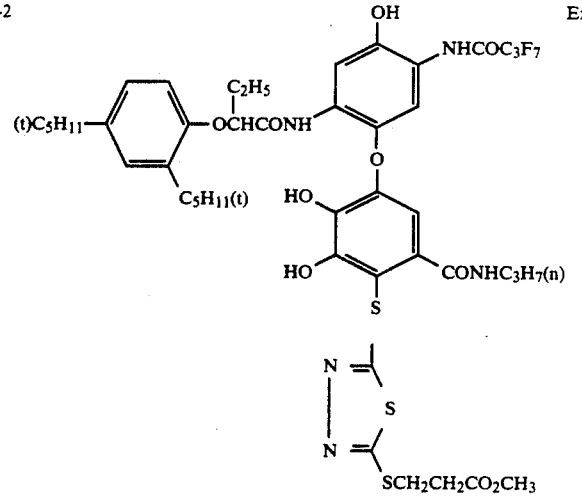
ExC-3

-continued
ExC-4
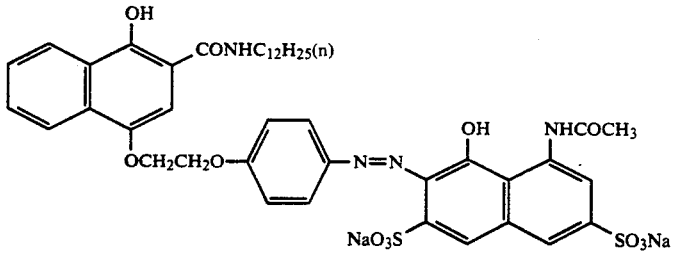
ExC-5
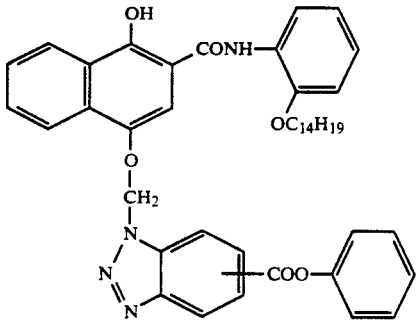
ExC-6
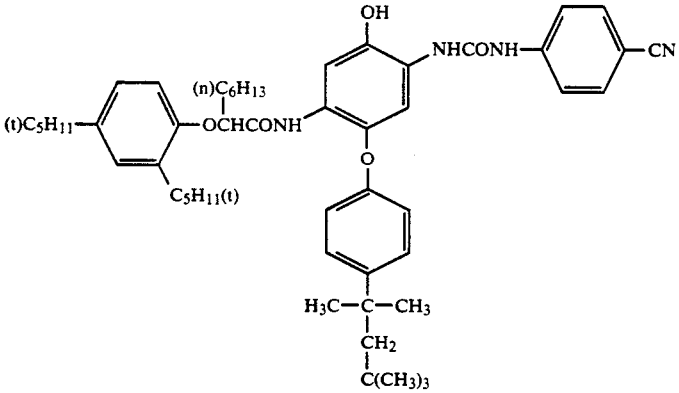
ExC-7
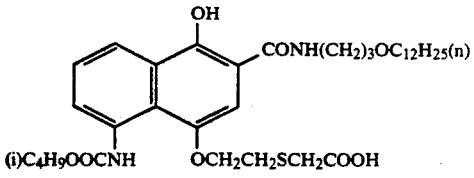
ExM-8
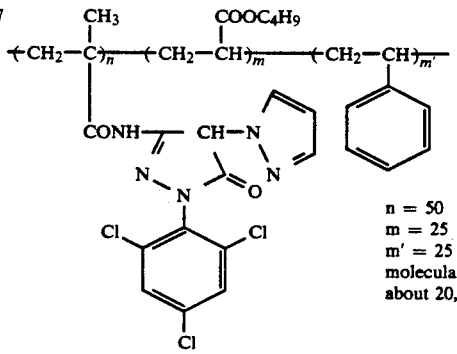
n = 50
m = 25
m' = 25
molecular weight
about 20,000

-continued
ExM-9
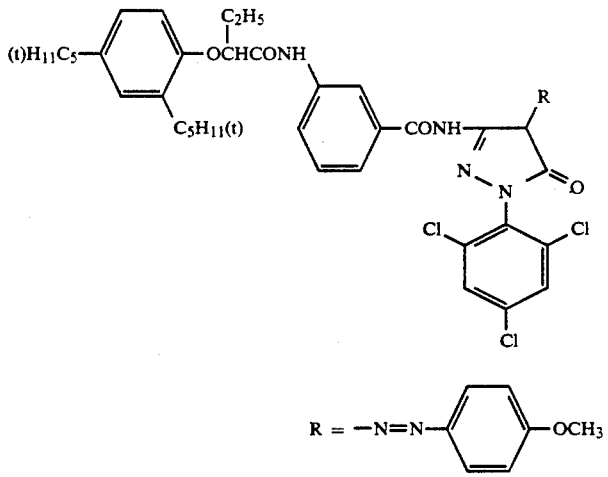
ExM-10
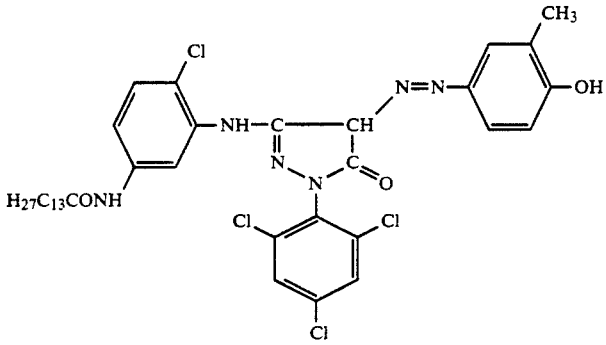
ExM-14
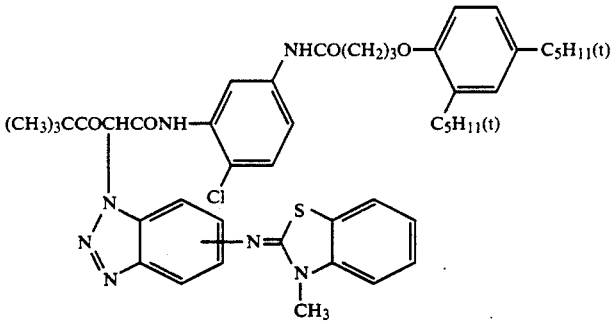
ExM-12
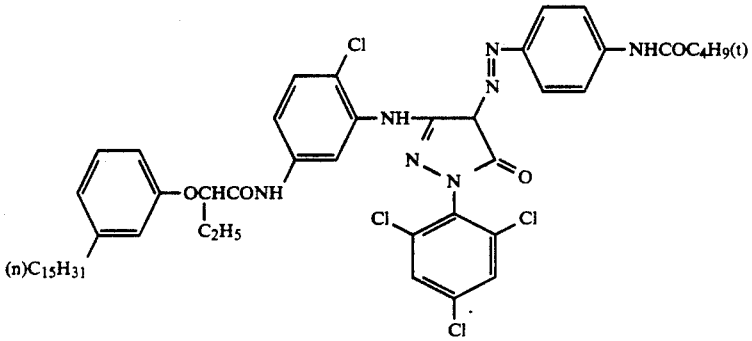

-continued
ExY-13
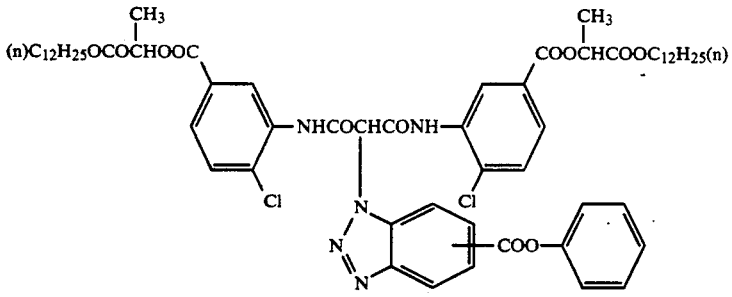
ExY-14
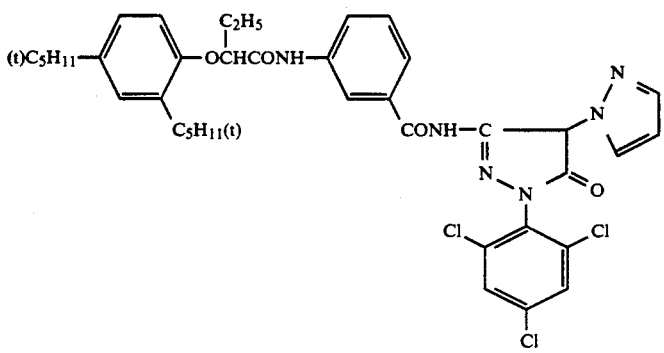
ExY-15
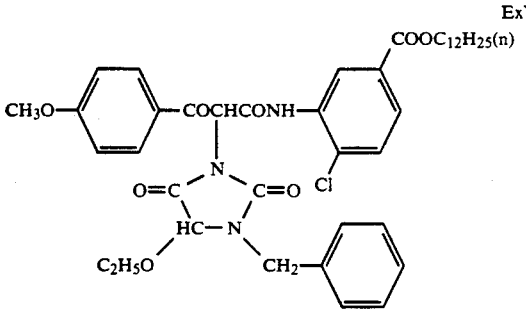
ExC-16
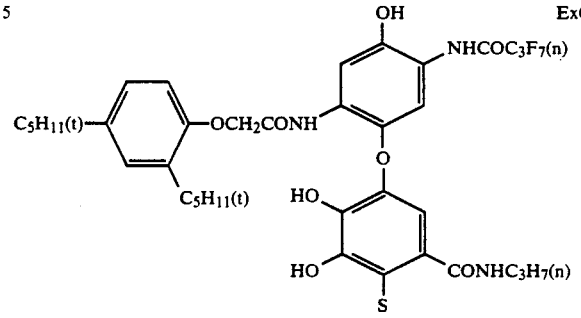
R = $SCH_2CH_2COOCH_3$
ExS-1
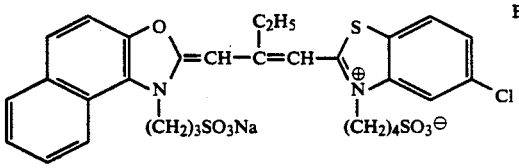
ExS-2
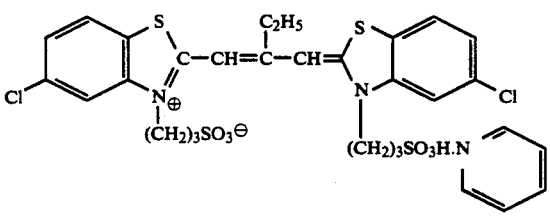
ExS-3
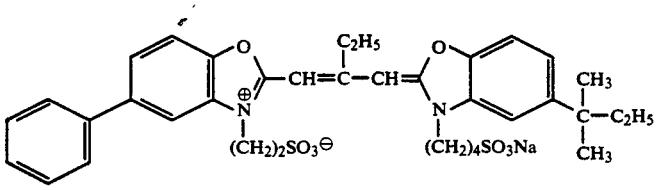

-continued

ExS-4

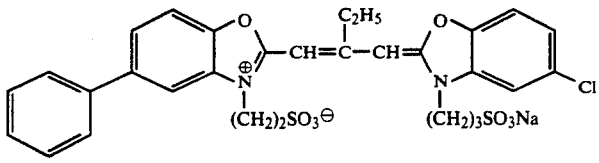

ExS-5

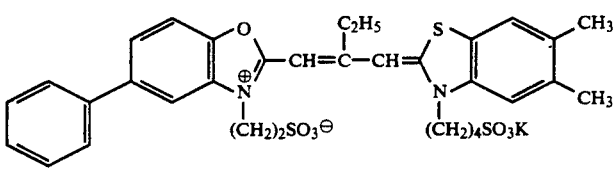

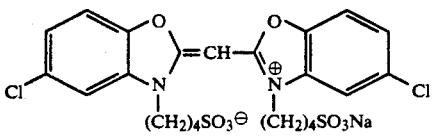

ExS-6 $CH_2=CH-SO_2-CH_2-CONH-CH_2$
$CH_2=CH-SO_2-CH_2-CONH-CH_2$

H-1

ExF-1

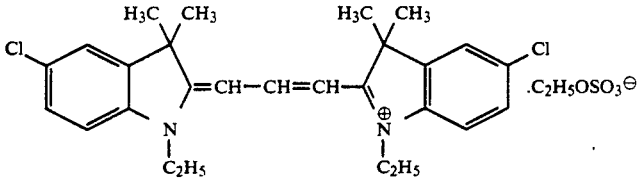

The thus-prepared multilayer color photographic material sample was exposed to light at 10 CMS at a color temperature of 4800° K and then processed in an automatic developing machine shown in FIG. 1 (processing speed is 40 cm/min.) in accordance with the procedure mentioned below (Table 1), whereupon the (aminopolycarboxylato)iron(III) complex (compounds (1) and (2)) in the bleaching solution and the pH value of the solution were varied as indicated below (Tables 2-1, 2-2).

TABLE 1

| Processing Steps (temperature 38° C.) | | |
|---|---|---|
| Steps | Processing Time | Tank Capacity |
| Color Development | 3 min 00 sec | 8 liters |
| Bleaching | 30 sec | 8 liters |
| Fixation | 1 min 30 sec | 8 liters |
| Stabilization (1) | 15 sec | 4 liters |
| Stabilization (2) | 15 sec | 4 liters |
| Stabilization (3) | 15 sec | 4 liters |

The thus processed sample was dried at 65° C. for 45 seconds. The crossover time between the respective steps was 5 seconds, and the processing time shown in Table 1 above includes the crossover time.

The compositions of the processing solutions used in the respective steps were as follows.

| | |
|---|---|
| Color Developer: | |
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-ethyl-N-β-hydroxyethylamino)-2-methylaniline Sulfate | 4.5 g |
| Water to make | 1 liter |
| | pH 10.0 |

-continued

| | |
|---|---|
| Bleaching Solution: | |
| Ammonium (1,3-diaminopropanetetra-acetato)iron(III) complex (1,3-DPTA.Fe) | See Table 2-1 and Table 2-2 |
| Bleaching Accelerator | $7 \times 10^{-3}$ mol |

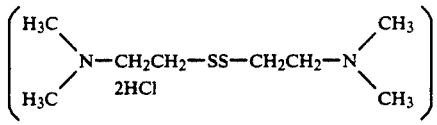

| | |
|---|---|
| Ammonium (Ethylenediaminetetracetato)iron(III) Complex (EDTA.Fe) | See Table 2-1 and Table 2-2 |
| 1,3-Diaminopropanetetraacetic Acid | 5.0 g |
| Ammonium Bromide | 150.0 g |
| Ammonium Nitrate | 10.0 g |
| pH | See Table 2 |
| Water to make | 1.0 liter |
| Fixing Solution: | |
| 1-Hydroxyethylidene-1,1-diphosphonic Acid | 5.0 g |
| Disodium Ethylenediaminetetraacetic Acid | 5.0 g |
| Sodium Sulfite | 4.0 g |
| Aqueous Ammonium Thiosulfate (70 wt. %/volume) | 240 ml |
| Sodium Bisulfite | 4.6 g |
| Water to make | 1.0 liter |
| | pH 6.6 |
| Stabilizer: | |
| Formalin (40 wt. %) | 1.0 ml |
| Polyoxyethylene-p-monononylphenyl Ether (mean polymerization degree; about 10) | 0.3 g |
| 5-Chloro-2-methyl-4-isothiazolin-3-one | 0.03 g |
| Water to make | 1.0 liter |

Stirring of the bleaching bath and the fixing bath was effected in accordance with two different systems: (1) a jet stream-stirring system and (2) a circulation-stirring system, which were applied to the bleach-fixing bath in Example 1 of JP-A-62-183460. The former system is an embodiment of the present invention, while the latter system is a comparative conventional embodiment. The jet stream of the processing solution was applied to the sample in 10 seconds after the sample was introduced into the bleaching bath or the fixing bath.

For the thus processed samples, the residual silver amounts in the 20 CMS-exposed area and the non-exposed area were measured by a fluorescent X-ray method. In addition, the degree of the stain, if any, of the processed sample was visually observed.

The results of the samples processed by circulation-stirring system of the bleaching bath are shown in Table 2-1 and those of samples processed by jet steam-stirring system of the bleaching bath are shown in Table 2-2.

| Stirring System: |
|---|
| J: Jet stream-stirring system, described in Example 1 of JP-A-62-183460 |
| N: Normal circulation-stirring system, described in Example 1 of JP-A-62-183460 |

non-bleached silver and the non-fixed silver halide; while the amount of the residual silver in the non-exposed area corresponds to the non-fixed silver halide only and is the value of the silver due to fixation failure.

As is clear from the results in Table 2-1, the amount of the silver due to fixation failure was far smaller in the case where the fixing solution was applied to the sample in accordance with a jet stream-stirring system (Examples Nos. 2 to 6 and Nos. 13 to 15, embodiments of the invention) than in the comparative case where the fixing solution was applied to the sample by conventional circulation-stirring system (comparative Examples Nos. 8 to 12 and Nos. 16 to 18).

In addition, when the bleaching solution was applied to the sample in accordance with a jet stream-stirring system, the amount of the silver due to fixation failure was further reduced when the fixing solution was applied to the sample by a jet stream-stirring system, but this effect could not be obtained when the fixing solu-

TABLE 2-1

| | Stirring System of Bleaching Solution: N | | | | | | | |
|---|---|---|---|---|---|---|---|---|
| | Composition of Bleaching Solution | | | | | Amount of Residual Silver ($\mu g/cm^2$) | | |
| Example No. | ① DETA.Fe mol/l | ② 1,3-DPTA Fe mol/l | ①/② | pH | Stirring System of Fixing Bath | 20 CMS | No Exposure | Stain (**) |
| 1R | 0.3 | 0 | ∞ | 4.3 | J | 23 | 5 | ○ |
| 2 | 0.225 | 0.075 | 3 | 4.3 | J | 10 | 5 | ○ |
| 3 | 0.2 | 0.1 | 2 | 4.3 | J | 8 | 5 | ○ |
| 4 | 0.15 | 0.15 | 1 | 4.3 | J | 7 | 5 | ○ |
| 5 | 0.1 | 0.2 | 0.5 | 4.3 | J | 7 | 5 | ○ |
| 6 | 0 | 0.3 | 0 | 4.3 | J | 8 | 8 | Δ |
| 7R | 0.3 | 0 | ∞ | 4.3 | N | 24 | 2 | ○ |
| 8R | 0.225 | 0.075 | 3 | 4.3 | N | 7 | 5 | Δ |
| 9R | 0.2 | 0.1 | 2 | 4.3 | N | 13 | 10 | X |
| 10R | 0.15 | 0.15 | 1 | 4.3 | N | 19 | 16 | X |
| 11R | 0.1 | 0.2 | 0.5 | 4.3 | N | 24 | 20 | X |
| 12R | 0 | 0.3 | 0 | 4.3 | N | 30 | 24 | X |
| 13 | 0.15 | 0.15 | 1 | 6.0 | J | 9 | 5 | ○ |
| 14 | 0.15 | 0.15 | 1 | 3.6 | J | 7 | 7 | ○ |
| 15 | 0.15 | 0.15 | 1 | 2.5 | J | 8 | 8 | Δ |
| 16R | 0.15 | 0.15 | 1 | 6.0 | N | 18 | 10 | X |
| 17R | 0.15 | 0.15 | 1 | 3.6 | N | 33 | 25 | X |
| 18R | 0.15 | 0.15 | 1 | 2.5 | N | 35 | 31 | X |

Notes:
(*) R indicates comparative example.
(**) Evaluation of Stain was as follows: ○: No Stain Δ: Slightly Stained X: Stained

TABLE 2-2

| | Stirring System of Bleaching Solution: J | | | | | | | |
|---|---|---|---|---|---|---|---|---|
| | Composition of Bleaching Solution | | | | | Amount of Residual Silver ($\mu g/cm^2$) | | |
| Example No. | ① DETA.Fe mol/l | ② 1,3-DPTA Fe mol/l | ①/② | pH | Stirring System of Fixing Bath | 20 CMS | No Exposure | Stain (**) |
| 1R | 0.3 | 0 | ∞ | 4.3 | J | 18 | 2 | ○ |
| 2 | 0.225 | 0.075 | 3 | 4.3 | J | 6 | 2 | ○ |
| 3 | 0.2 | 0.1 | 2 | 4.3 | J | 4 | 2 | ○ |
| 4 | 0.15 | 0.15 | 1 | 4.3 | J | 3 | 2 | ○ |
| 5 | 0.1 | 0.2 | 0.5 | 4.3 | J | 3 | 2 | ○ |
| 6 | 0 | 0.3 | 0 | 4.3 | J | 3 | 3 | Δ |
| 7R | 0.3 | 0 | ∞ | 4.3 | N | 20 | 2 | ○ |
| 8R | 0.225 | 0.075 | 3 | 4.3 | N | 5 | 5 | Δ |
| 9R | 0.2 | 0.1 | 2 | 4.3 | N | 10 | 10 | X |
| 10R | 0.15 | 0.15 | 1 | 4.3 | N | 16 | 16 | X |
| 11R | 0.1 | 0.2 | 0.5 | 4.3 | N | 20 | 20 | X |
| 12R | 0 | 0.3 | 0 | 4.3 | N | 24 | 24 | X |
| 13 | 0.15 | 0.15 | 1 | 6.0 | J | 7 | 2 | ○ |
| 14 | 0.15 | 0.15 | 1 | 3.6 | J | 4 | 4 | ○ |
| 15 | 0.15 | 0.15 | 1 | 2.5 | J | 5 | 5 | Δ |
| 16R | 0.15 | 0.15 | 1 | 6.0 | N | 15 | 10 | X |
| 17R | 0.15 | 0.15 | 1 | 3.6 | N | 31 | 25 | X |
| 18R | 0.15 | 0.15 | 1 | 2.5 | N | 33 | 31 | X |

In Tables 2-1 and 2-2, the amount of the residual silver in the 20 CMS-exposed area contains both the tion was applied to the sample by a conventional circulation-stirring system.

Further, as is noted from the results in Table 2-1 and 2-2, the amount of the residual silver in the non-exposed part increased in accordance with the increase of the proportion of 1,3-DPTA.Fe(III) and the photographic material samples processed were noticeably stained, when the fixation was effected by conventional circulation stirring (Comparative Examples Nos. 7 to 12).

As opposed to this, excellent desilvering which was free from these problems was possible, when the jet stream-stirring of the present invention was employed in the fixation step (Examples Nos. 2 to 6).

When the pH value of the bleaching solution was lowered, the fixation failure increased in the comparative case where the fixation was effected by conventional circulation stirring, while no fixation was noted in the case of the present invention where the fixation was effected by the jet stream-stirring system of the invention.

As is clear from the above results, the desilvering was effectively achieved by the method of the present invention and the photographic materials after being desilvered by the invention were not stained.

EXAMPLE 2

A multilayer color photographic material (Sample B) was prepared by forming the layers having the compositions shown below on a subbed cellulose triacetate film support.

The compositions of the layers were as follows, where values are the amount coated ($g/m^2$), and amount of the silver halide emulsion coated in the amount of silver therein. The amount of the sensitizing dye coated is represented by the molar unit to mol of the silver halide in the same layer.

| | |
|---|---|
| **First Layer: Anti-halation Layer** | |
| Black Colloidal Silver | 0.18 as Ag |
| Gelatin | 0.40 |
| **Second Layer: Interlayer** | |
| 2,5-Di-t-pentadecylhydroquinone | 0.18 |
| Ex-1 | 0.07 |
| Ex-3 | 0.02 |
| Ex-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| **Third Layer: First Red-sensitive Emulsion Layer** | |
| Monodispersed Silver Iodobromide Emulsion (AgI 6 mol %; mean grain size 0.6 μm; variation coefficient of grain size 0.15) | 0.55 as Ag |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| EX-2 | 0.350 |
| HBS-1 | 0.005 |
| EX-10 | 0.020 |
| Gelatin | 1.20 |
| **Fourth Layer: Second Red-sensitive Emulsion Layer** | |
| Tabular Silver Iodobromide Grain Emulsion (AgI 10 mol %; mean grain size 0.7 μm; mean aspect ratio 5.5; mean thickness 0.2 μm) | 1.0 as Ag |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| Ex-2 | 0.400 |
| EX-3 | 0.050 |

-continued

| | |
|---|---|
| EX-10 | 0.015 |
| Gelatin | 1.30 |
| **Fifth Layer: Third Red-sensitive Emulsion Layer** | |
| Silver Iodobromide Emulsion (AgI 16 mol %; mean grain size 1.1 μm) | 1.60 as Ag |
| Sensitizing Dye I | $5.4 \times 10^{-5}$ |
| Sensitizing Dye II | $1.4 \times 10^{-5}$ |
| Sensitizing Dye III | $2.4 \times 10^{-4}$ |
| Sensitizing Dye IV | $3.1 \times 10^{-5}$ |
| EX-3 | 0.240 |
| EX-4 | 0.120 |
| HBS-1 | 0.22 |
| HBS-2 | 0.10 |
| Gelatin | 1.63 |
| **Sixth Layer: Interlayer** | |
| EX-5 | 0.040 |
| HBS-1 | 0.020 |
| EX-12 | 0.004 |
| Gelatin | 0.80 |
| **Seventh Layer: First Green-sensitive Emulsion Layer** | |
| Tabular Silver Iodobromide Grain Emulsion (AgI 6 mol %; mean grain size 0.6 μm; mean aspect ratio 6.0; mean thickness 0.15 μm) | 0.40 as Ag |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-4 | 0.010 |
| Gelatin | 0.75 |
| **Eighth Layer: Second Green-sensitive Emulsion Layer** | |
| Monodispersed Silver Iodobromide Emulsion (AgI 9 mol %; mean grain size 0.7 μm; variation coefficient of grain size 0.18) | 0.80 as Ag |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| Ex-6 | 0.180 |
| EX-8 | 0.010 |
| EX-1 | 0.008 |
| EX-7 | 0.012 |
| HBS-1 | 0.160 |
| HBS-4 | 0.008 |
| Gelatin | 1.10 |
| **Nineth Layer: Third Green-sensitive Emulsion Layer** | |
| Silver Iodobromide Emulsion (AgI 12 mol %; mean grain size 1.0 μm) | 1.2 as Ag |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| Ex-6 | 0.065 |
| EX-11 | 0.030 |
| EX-1 | 0.025 |
| HBS-1 | 0.25 |
| HBS-2 | 0.10 |
| Gelatin | 1.74 |
| **Tenth Layer: Yellow Filter Layer** | |
| Yellow Colloidal Silver | 0.05 as Ag |
| EX-5 | 0.08 |
| HBS-3 | 0.03 |
| Gelatin | 0.95 |
| **Eleventh Layer: First Blue-sensitive Emulsion Layer** | |
| Tabular Silver Iodobromide Grain Emulsion (AgI 6 mol %; mean grain size 0.6 μm; mean aspect ratio 5.7; mean thickness 0.15 μm) | 0.24 as Ag |
| Sensitizing Dye VIII | $3.5 \times 10^{-4}$ |
| EX-9 | 0.85 |
| EX-8 | 0.12 |
| HBS-1 | 0.28 |
| Gelatin | 1.28 |
| **Twelfth Layer: Second Blue-sensitive Emulsion Layer** | |
| Monodispersed Silver Iodobromide Emulsion (AgI 10 mol %; mean grain size 0.8 μm; variation coefficient of grain size 0.16) | 0.45 as Ag |
| Sensitizing Dye VIII | $2.1 \times 10^{-4}$ |
| Ex-9 | 0.20 |
| EX-10 | 0.015 |

-continued

| | |
|---|---|
| HBS-1 | 0.03 |
| Gelatin | 0.46 |
| Thirteenth layer: Third Blue-sensitive Emulsion Layer | |
| Silver Iodobromide Emulsion (AgI 14 mol %; mean grain size 1.3 μm) | 0.77 as Ag |
| Sensitizing Dye VIII | $2.2 \times 10^{-4}$ |
| Ex-9 | 0.20 |
| HBS-1 | 0.07 |
| Gelatin | 0.69 |
| Fourteenth Layer: First Protective Layer | |
| Silver Iodobromide Emulsion (AgI 1 mol %; mean grain size 0.7 μm) | 0.5 as Ag |
| U-4 | 0.11 |

-continued

| | |
|---|---|
| U-5 | 0.17 |
| HBS-1 | 0.90 |
| Gelatin | 1.00 |
| Fifteenth Layer: Second Protective Layer | |
| Polymethyl Acrylate Grains (diameter: about 1.5μ) | 0.54 |
| S-1 | 0.15 |
| S-2 | 0.05 |
| Gelatin | 0.72 |

In addition to the above-mentioned components, a gelatin hardening agent H-1 and a surfactant were added to each of the respective layers.

The compounds used were as follows.

U-1: Same as UV-1 in Example 1

U-2: Same as UV-2 in Example 1

U-3: Same as UV-3 in Example 1

U-4: Same as UV-4 in Example 1

U-5: Same as UV-5 in Example 1

EX-1: Same as ExM-9 in Example 1

EX-2: Same as ExC-2 in Example 1

EX-3: Same as ExC-4 in Example 1

EX-4: Same as ExC-7 in Example 1

EX-5: Same as Cpd-1 in Example 1

EX-6: Same as ExM-8 in Example 1 (mean molecular weight: 30,000)

EX-7: Same as ExM-12 in Example 1

EX-8: Same as ExY-13 in Example 1

EX-9: Same as ExY-15 in Example 1

EX-10: Same as ExC-16 in Example 1

(R = $SCH(CH_3)COOCH_3$)

EX-11: Same as ExM-9 in Example 1 (R = H)

EX-12: Same as ExF-1 in Example 1

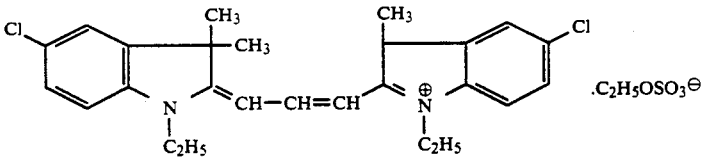

S-1: Same as Cpd-5 in Example 1

S-2: Same as Cpd-6 in Example 1

HBS-1: Tricresyl Phosphate (same as Solv-1 in Example 1)

HBS-2: Dibytl Phthalate (same as Solv-2 in Example 1)

HBS-3: Bis(2-ethylhexyl) Phthalate

HBS-4: Same as Solv-4 in Example 1

Sensitizing Dyes:

I

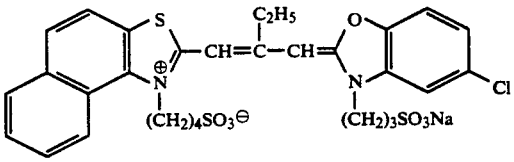

II

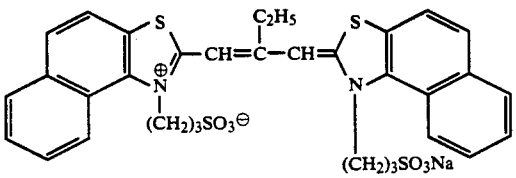

-continued

III

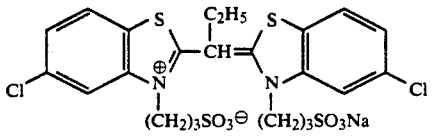

IV

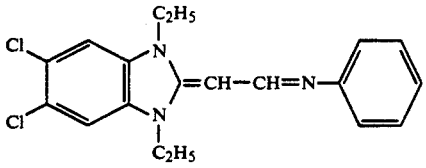

V

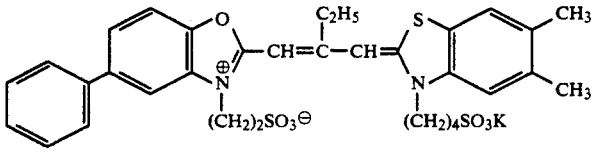

VI

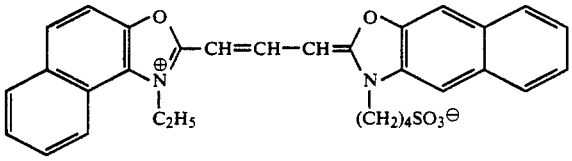

VII

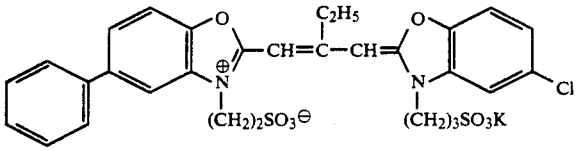

VIII

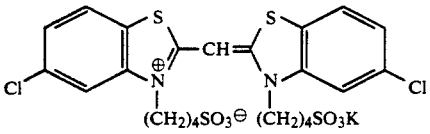

IX

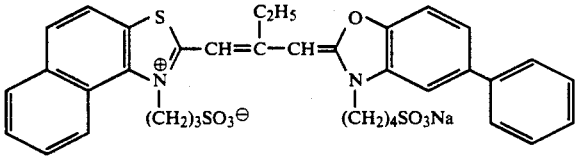

The thus prepared Sample (B) was imagewise exposed in the same manner as in Example 1 and then developed in accordance with the development procedure.

The nozzles used have a round shape, each nozzle has 5 mm in diameter. 30 nozzles are arranged in a way to have 3 nozzles horizontally and 10 nozzles vertically and those are placed at the same intervals. The distance from the nozzle to the emulsion surface of the photographic material is about 1 cm, and the liquid is circulated at 15 l/min of jet stream speed.

TABLE 3

| Processing Steps (temperature 38° C.) | | |
|---|---|---|
| Steps | Processing Time | Tank Capacity |
| Color Development | 3 min 00 sec | 8 liters |
| Bleaching | 1 min 30 sec | 8 liters |
| Fixation | 1 min 30 sec | 8 liters |
| Stabilization (1) | 15 sec | 4 liters |

TABLE 3-continued

| Processing Steps (temperature 38° C.) | | |
|---|---|---|
| Steps | Processing Time | Tank Capacity |
| Stabilization (2) | 15 sec | 4 liters |
| Stabilization (3) | 15 sec | 4 liters |

After being processed, the sample was dried at 65° C. for 45 seconds.

In the above procedure, the stabilization was effected by a three-tank countercurrent system from the bath (3) to (2) to (1).

The crossover time between the respective steps was 5 seconds, and the processing time shown in the Table 3 above includes the crossover time.

The color developer and the stabilization used were same as those used in Example 1, and the bleaching solution and fixing solution used were as follows.

| Bleaching Solution: | |
|---|---|
| Compound (A) (indicated in Table 4) | See Table 4 |
| Bleaching Accelerator (indicated in Table 4) | $7 \times 10^{-3}$ mol |
| Compound (B) (indicated in Table 4) | See Table 4 |
| Disodium Ethylenediaminetetraacetate | 10.0 g |
| Ammonium Bromide | 150.0 g |
| Ammonium Nitrate | 10.0 g |
| pH | See Table 4 |
| Water to make | 1.0 liter |
| **Fixing Solution:** | |
| Disodium Ethylenediaminetetraacetate | 5.0 g |
| Sodium Sulfite | 4.0 g |
| Aqueous Ammonium Thiosulfate Solution (70 wt. %/volume) | 240 ml |
| Sodium bisulfite | 4.6 g |
| Water to make | 1.0 liter |
| | pH 6.6 |

The stirring system in the bleaching bath and the fixing bath was same as that in Example 1. In Example 2, the position of the first nozzle from which the jet stream of the bleaching solution was jetted was varied to thereby vary the time from the introduction of the sample being processed into the bleaching bath to the first application of the jet stream of the bleaching solution to the same sample. Accordingly, the time-dependent effect of the jet stream of the bleaching solution applied to the sample was clarified.

The amount of the residual silver, the minimum yellow density and the maximum cyan density were measured for the thus processed samples, and the results are shown in Table 4 below.

For determination of the color density, an X-light 310 Photographic Densitometer was used.

TABLE 4

| No. | Bleaching Accelerator | Compound (A) (content) | Compound (B) (content) | pH | Stirring System | Amount of Residual silver ($\mu g/cm^2$) | Minimum Yellow Density | Maximum Cyan Density |
|---|---|---|---|---|---|---|---|---|
| 1 (Comparative Example) | — | Comparative Compound (0.3 mol) | — | 5.0 | J (5 sec) | 14.0 | 0.66 | 1.65 |
| 2 (Comparative Example) | (I)-(1) | Comparative Compound (0.3 mol) | — | 5.0 | J (5 sec) | 9.0 | 0.66 | 1.63 |
| 3 (Example of the Invention) | — | 1,3-DPTA.Fe (III) (0.3 mol) | — | 5.0 | N | 9.5 | 0.90 | 1.69 |
| 4 (Example of the Invention) | — | 1,3-DPTA.Fe (III) (0.3 mol) | — | 5.0 | J (20 sec) | 7.3 | 0.85 | 1.69 |
| 5 (Example of the Invention) | — | 1,3-DPTA.Fe(III) (0.3 mol) | — | 5.0 | J (15 sec) | 2.9 | 0.70 | 1.77 |
| 6 (Example of the Invention) | — | 1,3-DPTA.Fe(III) (0.3 mol) | — | 5.0 | J (10 sec) | 2.5 | 0.68 | 1.79 |
| 7 (Example of the Invention) | — | 1,3-DPTA.Fe(III) (0.3 mol) | — | 5.0 | J (5 sec) | 2.2 | 0.67 | 1.81 |
| 8 (Example of the Invention) | (I)-(1) | 1,3-DPTA.Fe(III) (0.3 mol) | — | 5.0 | J (10 sec) | 0.5 | 0.67 | 1.79 |
| 9 (Example of the Invention) | (I)-(1) | 1,3-DPTA.Fe(III) (0.3 mol) | — | 5.0 | J (5 sec) | 0.2 | 0.67 | 1.81 |
| 10 (Example of the Invention) | (I)-(1) | 1,3-DPTA.Fe(III) (0.15 mol) | Comparative Compound-(1) (0.15 mol) | 5.5 | J (5 sec) | 1.4 | 0.65 | 1.81 |
| 11 (Example of the Invention) | (I)-(1) | 1,3-DPTA.Fe(III) (0.15 mol) | Comparative Compound-(1) (0.15 mol) | 5.0 | J (5 sec) | 0.9 | 0.65 | 1.82 |
| 12 (Example of the Invention) | (I)-(1) | 1,3-DPTA.Fe(III) (0.15 mol) | Comparative Compound-(1) (0.15 mol) | 4.5 | J (5 sec) | 0.7 | 0.64 | 1.80 |
| 13 (Example of the Invention) | (II)-(2) | 1,3-DPTA.Fe(III) (0.15 mol) | Comparative Compound-(1) (0.15 mol) | 4.5 | J (5 sec) | 0.8 | 0.64 | 1.79 |
| 14 (Example of the Invention) | (III)-(1) | 1,3-DPTA-Fe(III) (0.15 mol) | Comparative Compound-(1) (0.15 mol) | 4.5 | J (5 sec) | 0.8 | 0.65 | 1.80 |
| 15 (Example of the Invention) | (V)-(1) | 1,3-DPTA-Fe(III) (0.15 mol) | Comparative Compound-(1) (0.15 mol) | 4.5 | J (5 sec) | 0.8 | 0.65 | 1.80 |
| 16 (Example of the Invention) | (IV)-(1) | 1,3-DPTA-Fe(III) (0.15 mol) | Comparative Compound-(1) (0.15 mol) | 4.5 | J (5 sec) | 1.2 | 0.64 | 1.81 |

The time as parenthesized in the item of Stirring System indicates a time from the introduction of the sample being processed into the bleaching bath to the application of the jet stream of the bleaching solution to the same sample.
J: Jet stream-stirring system, described in Example 1 of JP-A-62-183460
N: Normal circulation-stirring system, described in Example 1 of JP-A-62-183460
Comparative Compound (1): (Ethylenediaminetetraacetato)iron(III) Complex As is noted from the results of Tests Nos. 4 to 7 in Table 4 above, when the time from the introduction of the photographic material sample into the bleaching bath to the application of the jet stream of the bleaching solution to the same sample was 20 seconds, the amount of the residual silver in the sample processed was large and increase of the minimum yellow density (bleaching fog) and depression of the maximum cyan density (insufficiency in recoloration) were noticeable, however, when the said time was 15 seconds or less, these problems were overcome.

EXAMPLE 3

The same process as in Example 2 was repeated except that a multilayer color photographic material (Sample C) prepared as mentioned below was used in place of Sample (B) used in Example 2. The results obtained were the same as those in Table 4 of Example 2, and demonstrate that the method of the present invention is extremely excellent in desilvering capacity and is effective for prevention of bleaching fog and for prevention of insufficiency in recoloration of cyan dye.

In addition, it was also demonstrated that the method of the present invention is effective to improve image storability, which is often problematic in rapid photographic processing, as shown by the experimental data in Table 5 below.

For evaluation of image stability, the images formed were stored under the condition of 60° C. and relative humidity of 70 % for 2 weeks, and the variation of the minimum magenta density after and before storage was determined.

Sample (C) was prepared by forming the layers having the compositions shown below on a subbed cellulose triacetate film support.

The compositions of the layers were as follows. The amount coated is in units of g/m$^2$, calculated as silver for silver halide and colloidal silver, and in units of g/m$^2$ for couplers, additives and gelatin. The coated amount of sensitizing dye (ExS) is represented in molar amounts per mol of silver halide incorporated in the same layer.

| | |
|---|---|
| **First Layer: Anti-halation Layer** | |
| Black Colloidal Silver | 0.2 as Ag |
| Gelatin | 2.2 |
| UV-1 | 0.1 |
| UV-2 | 0.2 |
| Cpd-1 | 0.05 |
| Solv-1 | 0.01 |
| Solv-2 | 0.01 |
| Solv-3 | 0.08 |
| **Second Layer: Interlayer** | |
| Fine Silver Bromide Grains (sphere-corresponding diameter 0.07 μm) | 0.15 as Ag |
| Gelatin | 1.0 |
| Cpd-2 | 0.2 |
| **Third Layer: First Red-sensitive Emulsion Layer** | |
| Silver Iodobromide Emulsion (AgI 10.0 mol %, AgI-rich core type grains, sphere-corresponding diameter 0.7 μm; variation coefficient of sphere-corresponding diameter 14%; tetradecahedral grains) | 0.26 as Ag |
| Silver Iodobromide Emulsion (AgI 4 mol %, AgI-rich core type grains, sphere-corresponding diameter 0.4 μm; variation coefficient of sphere-corresponding diameter 22%, tetradecahedral grains) | 0.2 as Ag |
| Gelatin | 1.0 |
| ExS-1 | $4.5 \times 10^{-4}$ mol |
| ExS-1 | $1.5 \times 10^{-4}$ mol |
| ExS-3 | $0.4 \times 10^{-4}$ mol |
| ExS-4 | $0.3 \times 10^{-4}$ mol |
| ExC-1 | 0.33 |
| ExC-2 | 0.009 |
| ExC-3 | 0.023 |
| ExC-6 | 0.14 |

-continued

| | |
|---|---|
| **Fourth Layer: Second Red-sensitive Emulsion Layer** | |
| Silver Iodobromide Emulsion (AgI 16 mol %, AgI-rich core type grains, sphere-corresponding diameter 1.0 μm; variation coefficient of sphere-corresponding diameter 25%; tabular grains, ratio of diameter/thickness 4.0) | 0.55 as Ag |
| Gelatin | 0.7 |
| ExS-1 | $3 \times 10^{-4}$ |
| ExS-2 | $1 \times 10^{-4}$ |
| ExS-3 | $0.3 \times 10^{-4}$ |
| ExS-4 | $0.3 \times 10^{-4}$ |
| ExC-3 | 0.05 |
| ExC-4 | 0.10 |
| ExC-6 | 0.08 |
| **Fifth Layer: Third Red-sensitive Emulsion Layer** | |
| Silver Iodobromide Emulsion (AgI 10.0 mol %; AgI-rich core type grains, sphere-corresponding diameter 1.2 μm; variation coefficient of sphere-corresponding diameter 28%; tabular grains, ratio of diameter/thickness 6.0) | 0.9 as Ag |
| Gelatin | 0.6 |
| ExS-1 | $2 \times 10^{-4}$ |
| ExS-2 | $0.6 \times 10^{-4}$ |
| ExS-3 | $0.2 \times 10^{-4}$ |
| ExC-4 | 0.07 |
| ExC-5 | 0.06 |
| Solv-1 | 0.12 |
| Solv-2 | 0.12 |
| **Sixth Layer: Interlayer** | |
| Gelatin | 1.0 |
| Cpd-4 | 0.1 |
| **Seventh layer: First Green-sensitive Emulsion Layer** | |
| Silver Iodobromide Emulsion (AgI 1.0 mol %; AgI-rich core type grains, sphere-corresponding diameter 0.7 μm; variation coefficient of sphere-corresponding diameter 22%; tetradecahedral grains) | 0.2 as Ag |
| Silver Iodobromide Emulsion (AgI 4.0 mol %; AgI-rich core type; sphere-corresponding diameter 0.4 μm; variation coefficient of sphere-corresponding diameter 22%; tetradecahedral grains) | 0.1 as Ag |
| Gelatin | 1.2 |
| ExS-5 | $5 \times 10^{-4}$ |
| ExS-6 | $2 \times 10^{-4}$ |
| ExS-7 | $1 \times 10^{-4}$ |
| ExM-1 | 0.41 |
| ExM-2 | 0.10 |
| ExM-5 | 0.03 |
| Solv-1 | 0.2 |
| **Eighth Layer: Second Green-sensitive Emulsion Layer** | |
| Silver Iodobromide Emulsion (AgI 10 mol %; AgI-rich core type grains; sphere-corresponding diameter 1.0 μm; variation coefficient of sphere-corresponding diameter 25%; tabular grains; ratio of diameter/thickness 3.0) | 0.4 as Ag |
| Gelatin | 0.35 |
| ExS-5 | $3.5 \times 10^{-4}$ |
| ExS-6 | $1.4 \times 10^{-4}$ |
| ExS-7 | $0.7 \times 10^{-4}$ |
| ExM-1 | 0.09 |
| ExM-3 (same as ExM-12 in Example 1) | 0.01 |
| Solv-1 | 0.15 |
| **Nineth Layer: Interlayer** | |
| Gelatin | 0.5 |
| **Tenth Layer: Third Green-sensitive Emulsion Layer** | |
| Silver Iodobromide Emulsion (AgI 10.0 mol %; AgI-rich core type grains; sphere-corresponding diameter 1.2 μm; variation coefficient of sphere-corresponding diameter 28%; tabular grains; ratio of diameter/thickness 6.0) | 1.0 as Ag |
| Gelatin | 0.8 |
| ExS-5 | $2 \times 10^{-4}$ |
| ExS-6 | $0.8 \times 10^{-4}$ |
| ExS-7 | $0.8 \times 10^{-4}$ |
| ExM-3 | 0.01 |
| ExM-4 | 0.04 |
| Solv-1 | 0.2 |
| **Eleventh Layer: Yellow Filter Layer** | |

-continued

| | |
|---|---|
| Cpd-3 | 0.05 |
| Gelatin | 0.5 |
| Solv-1 | 0.1 |
| **Twelfth Layer: Interlayer** | |
| Gelatin | 0.5 |
| Solv-1 | 0.1 |
| **Thirteenth Layer: First Blue-sensitive Emulsion Layer** | |
| Silver Iodobromide Emulsion (AgI 10 mol %; I-rich core type grains; sphere-corresponding diameter 0.7 μm; variation coefficient of sphere-corresponding diameter 14%; tetradecahedral grains) | 0.1 as Ag |
| Silver Iodobromide Emulsion (AgI 4.0 mol %; I-rich core type grains; sphere-corresponding diameter 0.4 μm; variation coefficient of sphere-corresponding diameter 22%; tetradecahedral grains) | 0.05 as Ag |
| Gelatin | 1.0 |
| ExS-8 | $3 \times 10^{-4}$ |
| ExY-1 | 0.53 |
| ExY-2 | 0.02 |
| Solv-1 | 0.15 |
| **Fourteenth Layer: Second Blue-sensitive Emulsion Layer** | |
| Silver Iodobromide Emulsion (AgI 19.0 mol %; AgI-rich core type grains; sphere-corresponding diameter 1.0 μm; variation coefficient of sphere-corresponding diameter 16%; tetradecahedral grains) | 0.19 as Ag |
| Gelatin | 0.3 |
| ExS-8 | $2 \times 10^{-4}$ |
| ExY-1 | 0.22 |
| Solv-1 | 0.07 |

-continued

| | |
|---|---|
| **Fifteenth Layer: Interlayer** | |
| Fine Silver Iodobromide Grains (AgI 2 mol %; uniform type; sphere-corresponding diameter 0.13 μm) | 0.2 as Ag |
| Gelatin | 0.36 |
| **Sixteenth Layer: Third Blue-sensitive Emulsion Layer** | |
| Silver Iodobromide Emulsion (AgI 14.0 mol %; AgI-rich core type grains; sphere-corresponding diameter 1.5 μm; variation coefficient of sphere corresponding diameter 28%; tabular grains; ratio of diameter/thickness 5.0) | 1.0 as Ag |
| Gelatin | 0.5 |
| ExS-8 | $1.5 \times 10^{-4}$ |
| ExY-1 | 0.2 |
| Solv-1 | 0.07 |
| **Seventeenth Layer: First Protective Layer** | |
| Gelatin | 1.8 |
| UV-1 | 0.1 |
| UV-2 | 0.2 |
| Solv-1 | 0.01 |
| Solv-2 | 0.01 |
| **Eighteenth Layer: Second Protective Layer** | |
| Fine Silver Bromide Grain Emulsion (sphere-corresponding diameter 0.07 μm) | 0.18 as Ag |
| Gelatin | 0.7 |
| Polymethyl Methacrylate Grains (diameter 1.5 μm) | 0.2 |
| W-1 | 0.02 |
| H-1 | 0.4 |
| Cpd-5 | 1.0 |

The compounds used were as follows:

UV-1

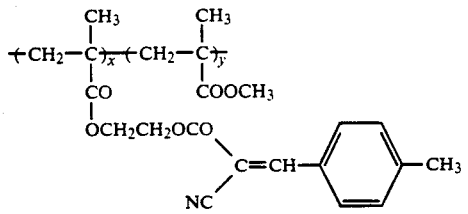

x/y = 7/3 (by weight)

UV-2

(Same as UV-5 in Example 1)

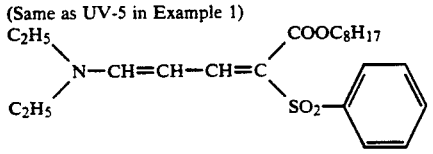

ExM-3

(Same as ExM-12 in Example 1)

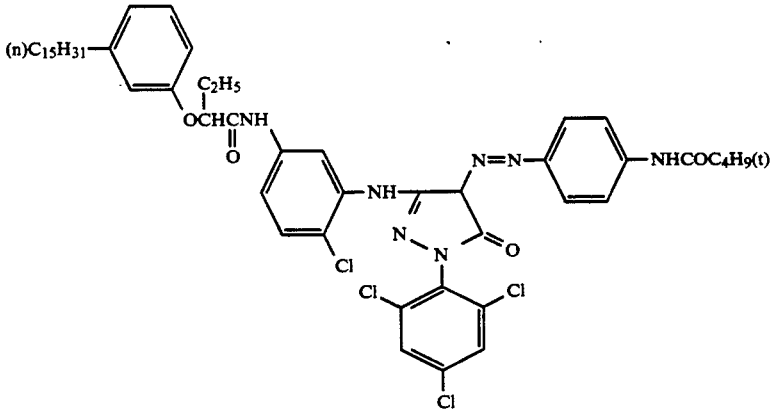

-continued
(Same as ExC-2 in Example 1) ExC-1
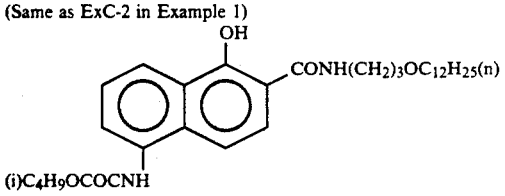
(Same as ExC-5 in Example 5) ExC-2
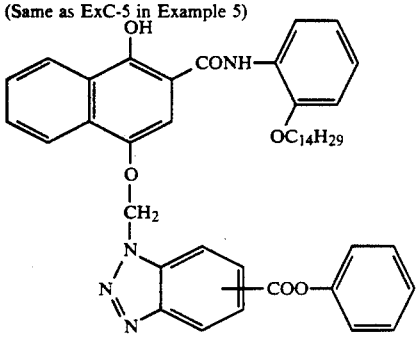
(Same as ExC-4 in Example 1) ExC-3
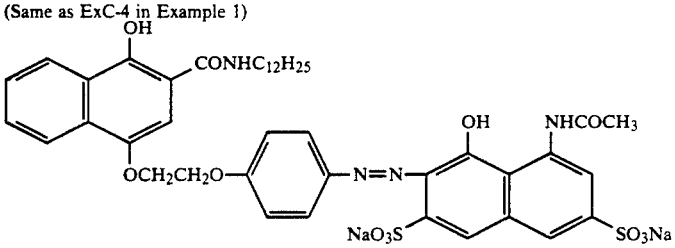
(Same as ExC-7 in Example 1) ExC-6
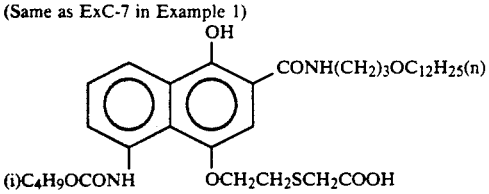
(Same as Compound C-5) ExC-4
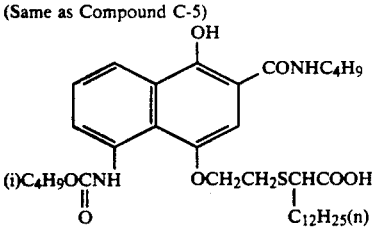
ExC-5
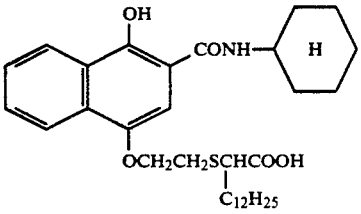

-continued
ExM-1
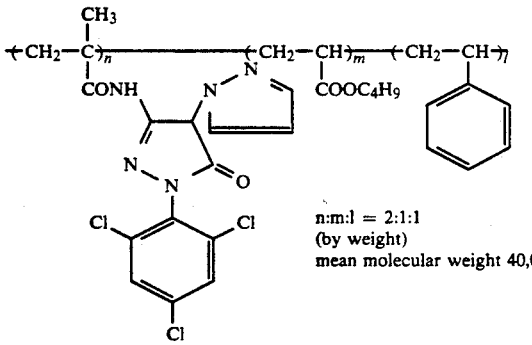
n:m:l = 2:1:1
(by weight)
mean molecular weight 40,000
ExM-2
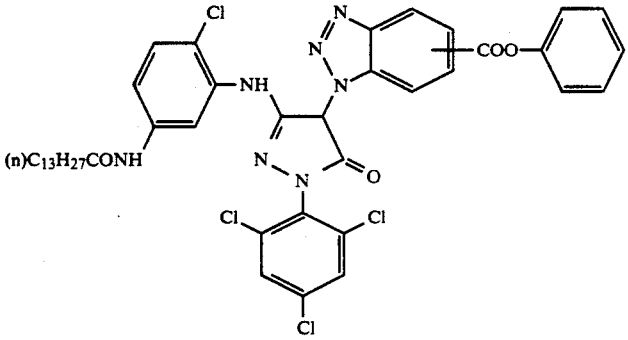
ExM-4
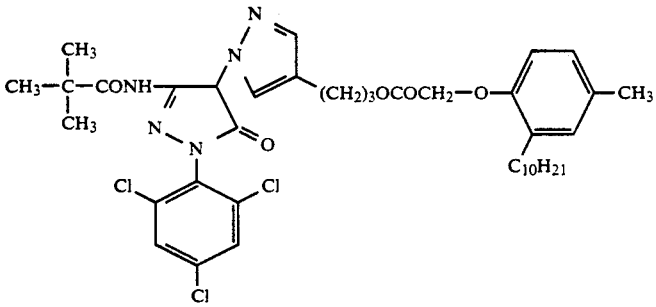
(Same as ExC-10 in Example 1)
ExM-5
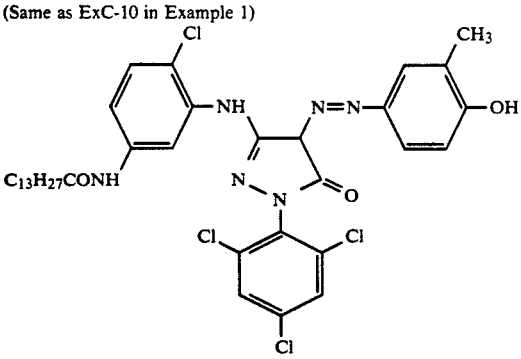
(Same as ExY-5 in Example 1)
ExY-1
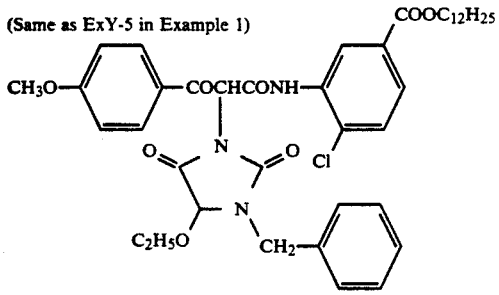

-continued
ExY-2
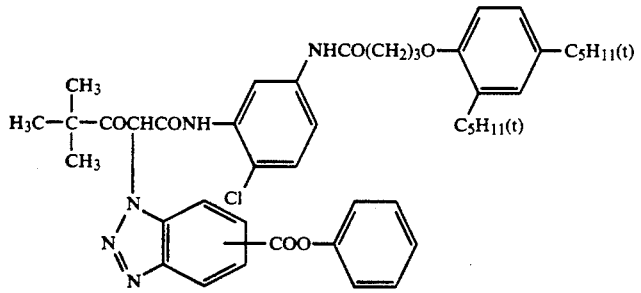
(Same as ExS-2 in Example 1)
ExS-1
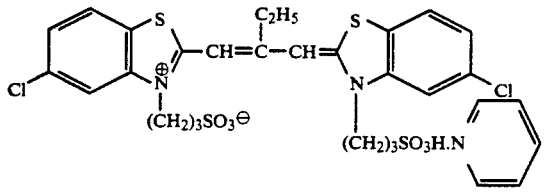
(Same as ExS-1 in Example 1)
ExS-2
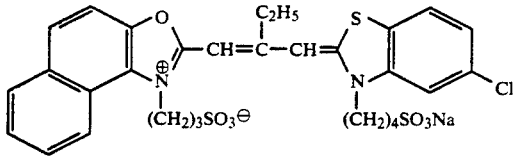
ExS-3
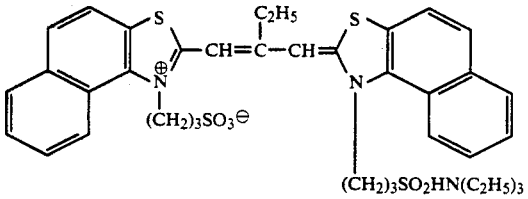
(Same as Sensitizing Dye IV in Example 2)
ExS-4
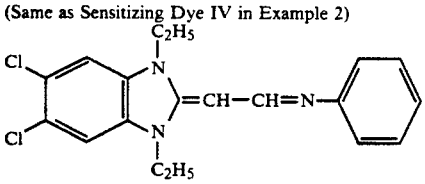
ExS-5
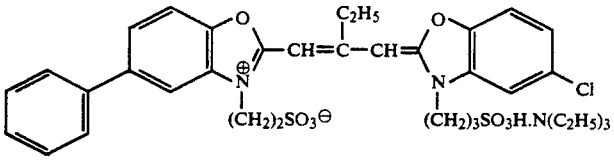
ExS-6
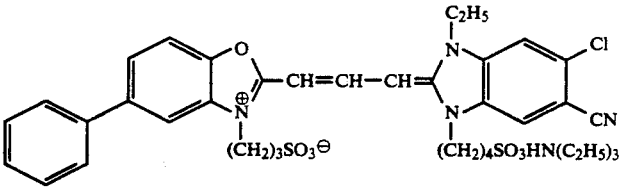
ExS-8
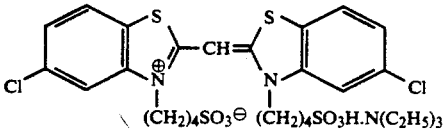

-continued
(Same as ExS-5 in Example 1) ExS-7
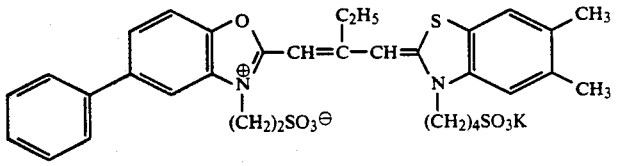
(Same as Solv-1 in Example 1) Solv-1
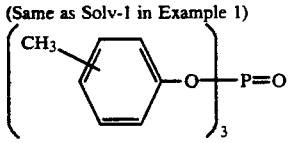
(Same as Solv-2 in Example 1) Solv-2
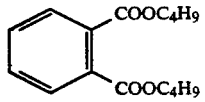
Solv-3
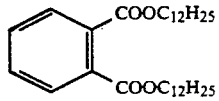
(Same as Solv-3 in Example 1) Solv-4
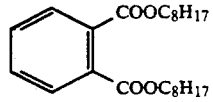
Cpd-1
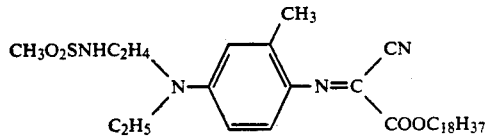
Cpd-2
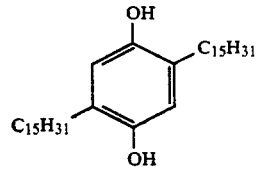
Cpd-3
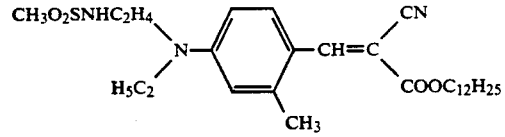
Cpd-4
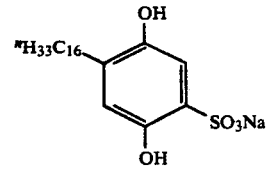
(Same as Compound-5 in Example 1) Cpd-5
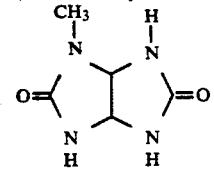

-continued
W-1
$C_8F_{17}SO_2NHCH_2CH_2CH_2OCH_2CH_2N^{\oplus}(CH_3)_3$
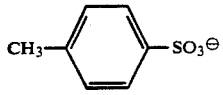
H-1
(Same as H-1 in Example 1)
$CH_2{=}CHSO_2CH_2CONH{-}CH_2$
$\quad\quad\quad TABLE 7-continued

| No. | Bleaching Accelerator | Compound (A) (content) | Compound (B) (content) | pH | Stirring system | Amount of Residual Silver ($\mu g/cm^2$) | Minimum Yellow Density | Maximum Cyan |
|---|---|---|---|---|---|---|---|---|
| the Invention) | | (0.3 mol) | | | | | | |
| | | 1,3-DPTA-Fe (III) (0.1 mol) | — | 7.3 | J (10 sec) | | | |
| 5 (Example of the Invention) | (III)-(1) | 1,3-DPTA-Fe (III) (0.15 mol) | Comparative Compound (1) (0.15 mol) | 5.0 | J (3 sec) | 1.8 | 0.63 | 1.80 |
| | | 1,3-DPTA-Fe (III) (0.05 mol) | Comparative Compound (1) (0.05 mol) | 7.3 | J (10 sec) | | | |
| 6 (Example of the Invention) | (IV)-(1) | 1,3-DPTA-Fe (III) (0.15 mol) | Comparative Compound (1) (0.15 mol) | 5.0 | J (3 sec) | 1.9 | 0.63 | 1.81 |
| | | 1,3-DPTA-Fe (III) (0.15 mol) | Comparative Compound (1) (0.15 mol) | 7.3 | J (10 sec) | | | |

In each experiment, the upper column indicates the condition for bleaching solution and the lower column that for bleach-fixing solution. the numeral as parenthesized in the item of Stirring system indicates a time from the introduction of the sample being processed into the bleaching bath to the application of the jet stream of the bleaching solution to the same sample.

As is clear from the data in Table 7, the method of the present invention proved effective in the procedure where the photographic material sample was bleached and then bleach-fixed.

EXAMPLE 5

The processes of Tests Nos. 2 to 6, Nos. 13 to 15 in Example 1 and Tests Nos. 3 to 16 in Example 2 were carried out, using color negative films mentioned below, and the same good results as those attained in Examples 1 (Table 2-1 and 2-2) and 2 were also attained.

| Color Negative Films Used: |
|---|
| Products by Fuji Photo Film Co. |
| Fuji Color Super HR 100 (Emulsion No. 6266689) |
| Fuji Color Super HR 200 (Emulsion No. 523009) |
| Fuji Color Super HR 400 (Emulsion No. 315059) |
| Fuji Color Super HR 1600 (Emulsion No. 723005) |
| Products by Konica Co. |
| Konica Color GX 100 (Emulsion No. 106) |
| Konica Color GX 400 (Emulsion No. 861) |
| Konica Color GX 3200 (Emulsion No. 751) |
| Products by Eastman Kodak Co. |
| Kadacolor VRG 100 (Emulsion No. 5095 104) |
| Kadacolor VRG 200 (Emulsion No. 5096 034) |
| Kadacolor VRG 400 (Emulsion No. 5097 123) |
| Kadacolor VRG 1000 (Emulsion No. 5090 254) |

EXAMPLE 6

Sample (B) of Example 2 was exposed to light at 20 CMS at 4800° K and then processed. The cyan dye density of the image formed was measured (first measurement). Next, the thus processed sample was dipped in the recloloring solution described below and then rinsed with water and dried. Then the cyan dye density was again measured (second measurement). The difference between the two values measured (Value of the second measurement minus value of the first measurement) indicates the degree of insufficiency in recoloration of cyan dye. The larger the value, the greater the insufficiency in recoloration.

The procedure of processing the exposed sample was as follows.

An automatic developing machine shown in FIG. 1, which was equipped with a conveyance mechanism, was used for processing the exposed sample. With reference to FIG. 1, which show a partial sectional view of one embodiment of an automatic developing apparatus for the method of the present invention, (1) is a processing solution level; (2) is a means for liquid sealing and liquid squeezing; (3) is a receiver of liquid drops; (4) is a following lid; (5) is a conveyance roller; (6) is a conveyance roller; (7) is a pair of facing rollers; (8) is photographic material being processed; (9) is a processing liquid tank; (10) is a conveyance level; (15) is a bleaching solution; (16) is a fixing solution; (17) is a jet stream pipe; (18) is a circulation pump; and (19) is a circulation pipe. The arrows from the jet stream pipe (17) indicate the jet stream of a fixing solution to be jetted from the nozzles as provided in the jet stream pipe. The fixing solution (16) is introduced into the jet stream pipe (17) via the circulation pipe (19) under section by the pump (18). At the position (18), the emulsion surface of the photographic material being processed faces downwards. In the fixing bath (16), the emulsion surface faces the jet stream pipe.

The crossover time between the bleaching solution and the fixing solution was varied, by changing the distance between the two tanks, as indicated in Table 8 below (Tests Nos. 1-1 to 9-2).

The processing procedure included the following

| Steps | Processing/time | Tank Capacity °C. | Amount of Replenisher (per m of 35 mm wide sample) ml |
|---|---|---|---|
| Color Development | 3 min 15 sec | 38 | 20 |
| Bleaching | 40 sec | 38 | 4 |
| Fixation | 1 min 15 sec | 38 | 30 |
| Rinsing (1) | 20 sec | 38 | — |
| Rinsing (2) | 20 sec | 38 | 20 |
| Stabilization | 20 sec | 38 | 35 |
| Drying | 1 min 15 sec | 50 to 70 | — |

The rinsing was carried out by a two-tank countercurrent system from the rinsing tank (2) to the rinsing tank (1). The processing time for all the steps (except the bleaching step) contained a 5 second-crossover time. The bleaching step included no crossover time.

The compositions of the processing solutions used were as follows.

| | Tank Solution | Replenisher |
|---|---|---|
| Color Developer: | | |
| Diethylenetriaminepentaacetic Acid | 5.0 g | 6.0 g |
| Sodium Sulfite | 5.0 g | 6.4 g |
| Potassium Carbonate | 30.0 g | 37.0 g |
| Potassium Bromide | 1.3 g | 0.3 g |
| Potassium Iodide | 1.2 mg | — |
| Hydroxylamine Sulfate | 2.0 g | 2.8 g |
| 4-(N-ethyl-N-β-hydroxyethylamino)-2-methylaniline Sulfate | 4.7 g | 5.3 g |
| Water to make | 1.0 l | 1.0 l |
| pH | 10.0 g | 10.20 g |
| Bleaching Solution: | | |
| Ammonium (ethylenediaminetetra-acetato)iron (III) Complex Dihydrate (EDTA.Fe) | 90.0 g | 130.0 g |
| Ammonium (1,3-diaminopropanetetra-acetato)ion (III) Complex (1,3-DPTA.Fe) | 45.0 g | 60.0 g |
| Bleaching Accelerator (*) | 0.005 mol | 0.007 mol |
| 1,3-Diaminopropanetetraacetic Acid | 4.0 g | 5.0 g |
| Ammonium Bromide | 200.0 g | 300.0 g |
| Ammonium Borate | 30.0 g | 50.0 g |
| Aqueous Ammonia (27%) | 20.0 ml | 23.0 ml |
| Acetic Acid (98%) | 9.0 ml | 15.0 ml |
| Water make | 1.0 l | 1.0 l |
| pH | 5.5 | 5.0 |
| Fixing Solution: | | |
| 1-Hydroxyethylidene-1,1-diphosphonic Acid | 5.0 g | 6.0 g |
| Sodium Sulfite | 7.0 g | 8.0 g |
| Sodium Bisulfite | 5.0 g | 5.5 g |
| Aqueous Ammonium Thiosulfate Solution (700 g/l) | 240.0 ml | 280.0 ml |

-continued

| | Tank Solution | Replenisher |
|---|---|---|
| Water to make | 1.0 l | 1.0 l |
| pH | 10.0 g | 10.20 g |
| Stabilizing solution: Tank Solution and replenisher were same. | | |
| Formalin (37%) | | 2.0 ml |
| Polyoxyethylene-p-monononylphenyl Ether (mean polymerization degree 10) | | 0.3 g |
| Disodium Ethylenediaminetetraacetic Acid | | 0.05 g |
| Water to make | | 1.0 l |
| pH | | 5.5 |

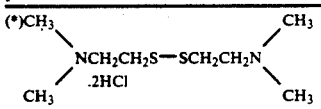

Rinsing Condition

City water was passed through a mixed bed column filled with an H-type strong acidic cation-exchange resin (Amberlite 1R-120B, product by Rhom and Haas Co.) and an OH-type anion-exchange resin (Amberlite IR-400, product by Rhom and Haas Co.) thereby to reduce the calcium ion concentration and the magnesium ion concentration to 3 mg/liter or less.

The results are shown in Table 8 below.

TABLE 8

| No. | Crossover Time | Jet Stream of Bleaching Solution | Jet Stream of Fixing Solution | Time Required until Arraival at Jet Stream of Fixing Solution | Amount of Residual Silver (μg/cm²) | Degree of Recoloration Insufficiency | Remarks |
|---|---|---|---|---|---|---|---|
| 1-1 | 20 sec | No | No | — | 23 | 0.03 | Comparative Example |
| 1-2 | | Yes | | | 23 | 0.03 | Comparative Example |
| 2-1 | 10 | No | No | — | 21 | 0.10 | Comparative Example |
| 2-2 | | Yes | | | 21 | 0.09 | Comparative Example |
| 3-1 | 10 | No | Yes | 20 sec | 9 | 0.10 | Example of the Invention |
| 3-2 | | Yes | | | 4 | 0.09 | Example of the Invention |
| 4-1 | 10 | No | Yes | 10 sec | 6 | 0.02 | Example of the Invention |
| 4-2 | | Yes | | | 3 | 0.01 | Example of the Invention |
| 5-1 | 10 | No | Yes | 5 sec | 5 | 0.01 | Example of the Invention |
| 5-2 | | Yes | | | 3 | 0.00 | Example of the Invention |
| 6-1 | 3 | No | No | — | 18 | 0.14 | Comparative Example |
| 6-2 | | Yes | | | 18 | 0.12 | Comparative Example |
| 7-1 | 3 | No | Yes | 20 sec | 8 | 0.13 | Example of the Invention |
| 7-2 | | Yes | | | 4 | 0.11 | Example of the Invention |
| 8-1 | 3 | No | Yes | 10 sec | 5 | 0.02 | Example of the Invention |
| 8-2 | | Yes | | | 3 | 0.00 | Example of the Invention |
| 9-1 | 3 | No | Yes | 5 sec | 4 | 0.01 | Example of the Invention |
| 9-2 | | Yes | | | 3 | 0.00 | Example of the Invention |

As is clear from the results in Table 8, the amount of the residual silver in the sample processed was noticeably reduced by application of the jet stream of the fixing solution to the sample. When the crossover time of the fixing solution was shortened, the insufficiency in recoloration increased. However, when the time required until arrival at the jet stream of the fixing solution was made 10 seconds or less, the insufficiency in recoloration was noted to be remarkably overcome.

EXAMPLE 7

Sample Nos. 101 to 108 in Example 1 and Examples Nos. 201 to 208 in Example 2 of the European Patent 285,1786 were imagewise exposed and then processed by the procedure described below, whereupon the processing was continued until the replenisher was consumed in an amount of two times the tank capacity of the color developer tank for running test. In the procedure, the composition of the bleaching solution was varied, as indicated in Table 9 below.

The automatic developing machine used in Example 8 was a belt conveyance type machine described in JP-A-60-191257, and the respective processing baths were stirred by the jet stream-stirring system described in JP-A-62-183460.

The processing steps were as follows.

| Steps | Processing/ time | Temperature °C. | Amount of Replenisher (per m of 35 mm wide sample) ml |
|---|---|---|---|
| Color Development | 3 min 15 sec | 38 | 38 |
| Bleaching | 1 min | 38 | 4 |
| Fixation | 1 min | 38 | 30 |
| Stabilization(1) | 20 sec | 38 | — |
| Stabilization(2) | 20 sec | 38 | 20 |
| Stabilization(3) | 20 sec | 38 | 35 ml (*) |
| Drying | 1 min 15 sec | 50 to 70 | — |

(*) The stabilization was carried out by a three-tank countercurrent system from the stabilization tank (3) to (2) to (1).

The crossover time in the respective steps was 5 seconds, and the above processing times include the crossover time.

The compositions of the processing solutions used were as follows.

| | Tank Solution | Replenisher |
|---|---|---|
| Color Developer: | | |
| Diethylenetriaminepentaacetic Acid | 5.0 g | 6.0 g |
| Sodium Sulfite | 4.0 g | 4.4 g |
| Potassium Carbonate | 30.0 g | 37.0 g |
| Potassium Bromide | 1.3 g | 0.9 g |
| Potassium Iodide | 1.2 mg | — |
| Hydroxylamine Sulfate | 2.0 g | 2.8 g |
| 4-(N-ethyl-N-β-hydroxyethylamino)-2-methylaniline Sulfate | 4.7 g | 5.3 g |
| Water to make | 1.0 l | 1.0 l |
| pH | 10.00 g | 10.05 g |
| Bleaching Solution: | | |
| Ammonium (Ethylenediaminetetra-acetato)iron (III) Complex Dihydrate (EDTA.Fe) | See Table 9 | See Table 9 |
| Ammonium (1,3-diaminopropanetetra-acetato)ion (III) Complex (1,3-DPTA.Fe) | See Table 9 | See Table 9 |
| Bleaching Accelerator (*) | See Table 9 | See Table 9 |
| 1,3-Diaminopropanetetraacetic Acid | 4.0 g | 5.0 g |
| Ammonium Bromide | 100.0 g | 160.0 g |
| Ammonium Borate | 30.0 g | 50.0 g |
| Aqueous Ammonia (27%) | 20.0 ml | 23.0 ml |
| Acetic Acid (98%) | 9.0 ml | 15.0 ml |
| Water to make | 1.0 l | 1.0 l |
| pH | See Table 9 | See Table 9 |
| Fixing Solution: | | |
| 1-Hydroxyethylidene-1,1-diphosphonic Acid | 5.0 g | 6.0 g |
| Sodium Sulfite | 7.0 g | 8.0 g |
| Sodium Bisulfite | 5.0 g | 5.5 g |
| Aqueous Ammonium Thiosulfate Solution (700 g/l) | 170.0 ml | 200.0 ml |
| Water to make | 1.0 l | 1.0 l |
| pH | 6.7 | 6.6 |
| Stabilizing Solution: Tank Solution and replenisher were the same. | | |
| Formalin (37%) | | 1.2 ml |
| 5-Chloro-2-methyl-4-isothiazolin-3-one | | 6.0 mg |
| 2-Methyl-4-isothiazoline-3-one | | 3.0 mg |
| Surfactant ($C_{10}H_{21}$—O—$(CH_2CH_2O)_{10}$—H) | | |
| Ethylene Glycol | | 1.0 g |
| Water to make | | 1.0 l |
| pH | | 5.0 to 7.0 |

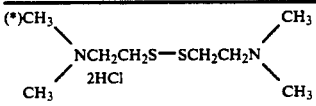

The above sample were exposed with light at 20 CMS and then processed with the running-equilibrated solution, and the amount of the residual silver in the thus processed samples was measured by a fluorescent X-ray method.

As a result, the difference in the photographic characteristic between the samples Nos. 101 to 108 and that between the sample Nos. 201 to 208 were relatively small despite of the extreme difference between the bleaching solutions (A) to (I) used.

Regarding the amount of the residual silver, the sample processed with the bleaching solution (A) had the largest residual silver amount and that processed with the bleaching solution (B) had the second largest residual silver amount, while the samples processed with bleaching solutions (D), (E) and (H) had the smallest residual silver amount. It is noted from the results, that the ratio of EDTA.Fe/1,3-EDTA.Fe in the bleaching solution is preferably 3 to less.

While the invention has been described in detail and with reference to specific embodiments thereof, it will be apparent to one skilled in the art that various changes and modifications can be made therein without departing from the spirit and scope thereof.

TABLE 9

| Bleaching Solution | Composition of Bleaching Solution: EDTA.Fe/1,3-DPTA.Fe (*) | Amount of Bleaching Accelerator (g/liter) Added to both Mother Liquid and Replenisher | pH after Running Test (Value Parenthesized Indicates pH of Replenisher) |
|---|---|---|---|
| A | 4 | 2 | 5.1 (3.7) |
| B | 3 | 2 | 5.1 (3.7) |
| C | 1.8 | 2 | 5.1 (3.7) |
| D | 1 | 2 | 5.1 (3.7) |
| E | 0.5 | 2 | 5.1 (3.7) |
| F | 0 | 2 | 5.1 (3.7) |
| G | 1 | 2 | 6.0 (4.8) |

TABLE 9-continued

| Bleaching Solution | EDTA.Fe/1,3-DPTA.Fe (*) | Composition of Bleaching Solution: Amount of Bleaching Accelerator (g/liter) Added to both Mother Liquid and Replenisher | pH after Running Test (Value Parenthesized Indicates pH of Replenisher) |
|---|---|---|---|
| H | 1 | 2 | 5.5 (4.5) |
| I | 1 | — | 5.1 (3.7) |

*The total of EDTA.Fe and 1,3-DPTA.Fe was 0.30 mol/liter (in tank solution) and 0.45 mol/liter (in replenisher) in every processing.

What is claimed is:

1. A method of processing a silver halide color photographic material comprising the steps of:
   (a) color-developing an imagewise exposed silver halide color photographic material comprising a support having thereon at least one light-sensitive silver halide emulsion layer;
   (b) bleaching said color-developed color photographic material with a bleaching solution containing a (1,3-diamino-propanetetraacetato)iron(III) complex; and
   (c) fixing said photographic material by immersing said material from step (b) in a solution having a fixing ability and, within 15 seconds or less after said immersing, contacting the emulsion surface of said material from step (b) with a jet stream of a solution having a fixing ability and with said jet stream having a flow velocity at a nozzle of 0.3 m/sec to 3 m/sec.

2. The method as claimed in claim 1, wherein said solution having a fixing ability is a fixing solution.

3. The method as claimed in claim 1, wherein said photographic material is contacted by said jet stream within 10 seconds after being introduced into said bath.

4. The method as claimed in claim 1, wherein said solution having a fixing ability is a fixing solution containing a thiosulfate in an amount of from 50 to 500 g per liter of the fixing solution.

5. The method as claimed in claim 1, wherein the processing time from the beginning of step (b) to the end of step (c) is from 1 minute to 4 minutes.

6. The method as claimed in claim 1, wherein said (1,3-diamino-propanetetraacetato)iron(III) complex is an ammonium salt complex.

7. The method as claimed in claim 1, wherein said bleaching solution contains from 0.05 mol to 1 mol of said (1,3-diamino-propanetetraacetato)iron(III) complex per liter of, said bleaching solution.

8. The method as claimed in claim 1, wherein said bleaching solution further contains at least one ferric complex of an acid selected from the group consisting of ethylenediaminetetraacetic acid, diethylenetriaminepentaacetic acid, cyclohexanediaminetetraacetic acid and 1,2-propylenediaminetetraacetic acid.

9. The method as claimed in claim 8, wherein said bleaching solution contains from 0.1 to 3.0 mols of said ferric complex per mol of (1,3-diaminopropanetetraacetato)iron(III) complex.

10. The method as claimed in claim 1, wherein the emulsion surface of said developed color photographic material in step (b) is contacted with a jet stream in a bath of said bleaching solution.

11. The method as claimed in claim 1, wherein the pH of said bleaching solution in step (b) is from 5.5 to 2.0.

12. The method as claimed in claim 11, wherein the pH of said bleaching solution in step (b) is from 5.0 to 3.0.

13. The method as claimed in claim 12, wherein the pH of said bleaching solution in step (b) is from 4.5 to 3.5.

14. The method as claimed in claim 1, wherein the interval between said developing step (a) and said bleaching solution processing step (b) is at most 10 seconds.

15. The method as claimed in claim 1, wherein the interval between said bleaching solution processing step (b) and said processing step (c) with the jet stream of the solution having a fixing ability is 10 seconds or less.

16. The method as claimed in claim 1, wherein the said bleaching solution has a bromide ion concentration of from 1.2 to 3.0 mols/liter.

17. The method as claimed in claim 1, wherein the silver halide contained in said silver halide color photographic material contains 30 mol % or less of silver iodide.

18. The method as claimed in claim 1, wherein the silver halide of said silver halide emulsion layer contains about 1 to 25 mol % of silver iodide.

* * * * *